US007940155B2

(12) United States Patent
Katsumura et al.

(10) Patent No.: US 7,940,155 B2
(45) Date of Patent: May 10, 2011

(54) VARISTOR AND ELECTRONIC COMPONENT MODULE USING SAME

(75) Inventors: Hidenori Katsumura, Hyogo (JP); Tatsuya Inoue, Osaka (JP); Keiji Kobatashi, Osaka (JP)

(73) Assignee: Panasonic Corporation, Osaka (JP)

( * ) Notice: Subject to any disclaimer, the term of this patent is extended or adjusted under 35 U.S.C. 154(b) by 614 days.

(21) Appl. No.: 11/817,710

(22) PCT Filed: Mar. 29, 2006

(86) PCT No.: PCT/JP2006/306440
§ 371 (c)(1),
(2), (4) Date: Sep. 4, 2007

(87) PCT Pub. No.: WO2006/106717
PCT Pub. Date: Oct. 12, 2006

(65) Prior Publication Data

US 2009/0027157 A1 Jan. 29, 2009

(30) Foreign Application Priority Data

Apr. 1, 2005 (JP) ..... 2005-105874
Feb. 17, 2006 (JP) ..... 2006-040578

(51) Int. Cl.
*H01C 7/10* (2006.01)

(52) U.S. Cl. ..... 338/21; 338/307; 338/309

(58) Field of Classification Search ..... 338/21, 338/22 R, 307, 309
See application file for complete search history.

(56) References Cited

U.S. PATENT DOCUMENTS

| | | | | |
|---|---|---|---|---|
| 5,075,665 | A | 12/1991 | Taira et al. | |
| 5,700,548 | A | 12/1997 | Warnier et al. | |
| 5,757,263 | A * | 5/1998 | Ravindranathan | 338/21 |
| 6,087,923 | A * | 7/2000 | Ahn et al. | 338/21 |
| 6,147,588 | A * | 11/2000 | Nakayama et al. | 338/21 |
| 7,189,297 | B2 * | 3/2007 | Katsumura et al. | 156/89.12 |
| 7,279,724 | B2 * | 10/2007 | Collins et al. | 257/103 |
| 2005/0141166 | A1 | 6/2005 | Katsumura et al. | |
| 2005/0190541 | A1 * | 9/2005 | Yang et al. | 361/719 |

FOREIGN PATENT DOCUMENTS

| | | |
|---|---|---|
| JP | 02-014501 | 1/1990 |
| JP | 02-135702 | 5/1990 |
| JP | 02-220407 | 9/1990 |
| JP | 02-220407 A | 9/1990 |
| JP | 05-006809 | 1/1993 |
| JP | 05-006809 A | 1/1993 |
| JP | 5-9024 | 2/1993 |
| JP | 07-235445 | 9/1995 |
| JP | 07-235445 A | 9/1995 |
| JP | 08-031616 | 2/1996 |
| JP | 11-233309 | 8/1999 |
| JP | 11-233309 A | 8/1999 |
| JP | 2005-191205 | 7/2005 |
| JP | 2005-191205 A | 7/2005 |

OTHER PUBLICATIONS

International Search Report Dated Jul. 11, 2006. Japanese Office action for JP2007-512781.

* cited by examiner

*Primary Examiner* — Kyung Lee
(74) *Attorney, Agent, or Firm* — Pearne & Gordon LLP

(57) ABSTRACT

A varistor includes a ceramic substrate having an insulating property, a varistor layer provided on the ceramic substrate and mainly containing zinc oxide, a first glass ceramic layer provided on the second surface of the varistor layer, first and second internal electrodes provided in the varistor layer and facing each other. The varistor has a small, thin size, and has sufficient varistor characteristics against surge voltages. The varistor provides a small electronic component module with resistance to static electricity and surge voltages.

29 Claims, 18 Drawing Sheets

12
14
12H
10μm
Zn
Bi
Co
Sb
Intensity

Fig. 4A

| | Varistor Voltage (V) | | | | V(1mA)/ V(0.1mA) |
|---|---|---|---|---|---|
| Current | 1 | 0.1 | 0.01 | 0.001 | |
| Sample | 25.3 | 23.0 | 19.9 | 17.6 | 1.10 |
| Comparative Sample | 40.1 | 35.2 | 30.9 | 26.1 | 1.14 |

Fig. 4B

| | Varistor Voltage (V) | | | | V(1mA)/ V(0.1mA) |
|---|---|---|---|---|---|
| Current | 1 | 0.1 | 0.01 | 0.001 | |
| Sample | 25.3 | 23.0 | 19.9 | 17.4 | 1.10 |
| Comparative Sample | 27.4 | 15.0 | 8.1 | 4.5 | 1.83 |

VARISTOR AND ELECTRONIC COMPONENT MODULE USING SAME

TECHNICAL FIELD

The present invention relates to a varistor for use in electronic apparatuses for protecting the apparatuses from any fault with static electricity or serge voltage, and to an electronic component module including the varistor and an electronic component.

BACKGROUND OF THE INVENTION

As electronic apparatuses, such as mobile telephones, have rapidly having small overall sizes and low power consumption, components for constructing various circuits in the apparatuses have low withstand voltages. As the result, the electronic apparatuses have more troubles, such as breakdown of the electronic components, particularly semiconductor devices, which is caused by static pulses generated when conductive parts in the electronic apparatuses contact a human body.

A light emitting diode, a semiconductor device or an electronic component, is widely used as a back light of a display or as a flash light of a small camera. Such a light emitting diode, however, has a low withstand voltage.

In order to protect the light emitting diode, a varistor connected between a ground and a line having static pulses entering thereto for bypassing the static pulses to the ground, thus preventing a high voltage from being applied to the diode.

FIG. 24 is a cross-sectional view of a conventional multilayer chip varistor 105 disclosed in Japanese Patent Laid-Open Publication No. 8-31616. Multilayer chip varistors have small overall sizes and are often used in small electronic apparatuses. The multilayer chip varistor 105 includes a varistor layer 102 having internal electrodes 100 and terminals 103 connected to the internal electrodes 100 at both ends of the varistor layer 102. Protective layers 104 are provided on upper and lower surfaces of the varistor layer 102.

Varistor layer 102 has a certain thickness enough to have a physical strength avoiding breakage and chipping, and accordingly, prevents the varistor 105 from having a small thickness. For example, the multilayer chip varistor, upon having a length of 1.25 mm and a width of 2.0 mm, has a thickness not smaller than 0.5 mm, thus being prevented from a small thickness. Even if having a predetermined mechanical strength, a thinner varistor allows bismuth oxide, a component of the varistor layer 102, more to evaporate during a baking process, accordingly having varistor characteristics and reliability of the varistor deteriorate.

SUMMARY OF THE INVENTION

A varistor includes a ceramic substrate having an insulating property, a varistor layer provided on the ceramic substrate and mainly containing zinc oxide, a first glass ceramic layer provided on the second surface of the varistor layer, first and second internal electrodes provided in the varistor layer and facing each other.

The varistor has a small, thin size, and has sufficient varistor characteristics against surge voltages. The varistor provides a small electronic component module with resistance to static electricity and surge voltages.

BRIEF DESCRIPTION OF THE DRAWINGS

FIG. 4A shows a measurement result of varistor characteristics of samples according to exemplary embodiments.

FIG. 4B shows a measurement result of varistor characteristics of samples according to the embodiments.

REFERENCE NUMERALS

11A Internal Electrode (First Internal Electrode)
11B Internal Electrode (Second Internal Electrode)
12 Varistor Layer
12A Surface of Varistor Layer (Second Surface of Varistor Layer)
13 Ceramic Substrate
13A Surface of Ceramic Substrate (Second surface of Ceramic Substrate)
13B Surface of Ceramic Substrate (First Surface of Ceramic Substrate)
14 Glass Ceramic Layer (First Glass Ceramic Layer)
14A Surface of Glass Ceramic Layer (Second surface of First Glass Ceramic Layer)
14B Surface of Glass Ceramic Layer (First surface of First Glass Ceramic Layer)
15A External Electrode (First External Electrode)
15B External Electrode (Second External Electrode)
16A Terminal Electrode (First Terminal Electrode)
16B Terminal Electrode (Second Terminal Electrode)
17A Via-Hole Electrode (First Via-Hole Electrode)
17B Via-Hole Electrode (Second Via-Hole Electrode)
18 Light Emitting Diode (Electronic Component)
18A Terminal (First Terminal)
18B Terminal (Second Terminal)
20A Terminal Electrode (First External Electrode)
20B Terminal Electrode (Second External Electrode)
21 Hole
21A Wall surface
22A Via-Hole Electrode (First Via-Hole Electrode)
24 Hole
24A Wall surface
24B Opening
25 Light Reflecting Layer
27 Glass Ceramic Layer (Second Glass Ceramic Layer)
30 Insulating Layer
32 Thermally Conductive Layer
38 Light Emitting Diode (Electronic Component)
38A Terminal (First Terminal)
38B Terminal (Second Terminal)
56A Terminal Electrode (First External Electrode)
56B Terminal Electrode (Second External Electrode)
66A Terminal Electrode (First External Electrode)
66B Terminal Electrode (Second External Electrode)
117A Via-Hole Electrode (First Via-Hole Electrode)
117B Via-Hole Electrode (Second Via-Hole Electrode)
217A Via-Hole Electrode (First Via-Hole Electrode)
217B Via-Hole Electrode (Second Via-Hole Electrode)
124 Hole
124 Wall Surface
124B Opening
317A Via-Hole Electrode (First Via-Hole Electrode)
317B Via-Hole Electrode (Second Via-Hole Electrode)
511A Internal Electrode (First Internal Electrode)
511B Internal Electrode (Second Internal Electrode)
611A Internal Electrode (First Internal Electrode)
611B Internal Electrode (Second Internal Electrode)
711A Internal Electrode (First Internal Electrode)
711B Internal Electrode (Second Internal Electrode)
811A Internal Electrode (First Internal Electrode)
811B Internal Electrode (Second Internal Electrode)
911A Internal Electrode (First Internal Electrode)
911B Internal Electrode (Second Internal Electrode)
5012B Surface of Varistor Layer (First surface of Varistor Layer)
5021B Opening
5022B Via-Hole Electrode (Second Via-Hole Electrode)

DETAIL DESCRIPTION OF THE PREFERRED EMBODIMENTS

Exemplary Embodiment 1

Figure 1:
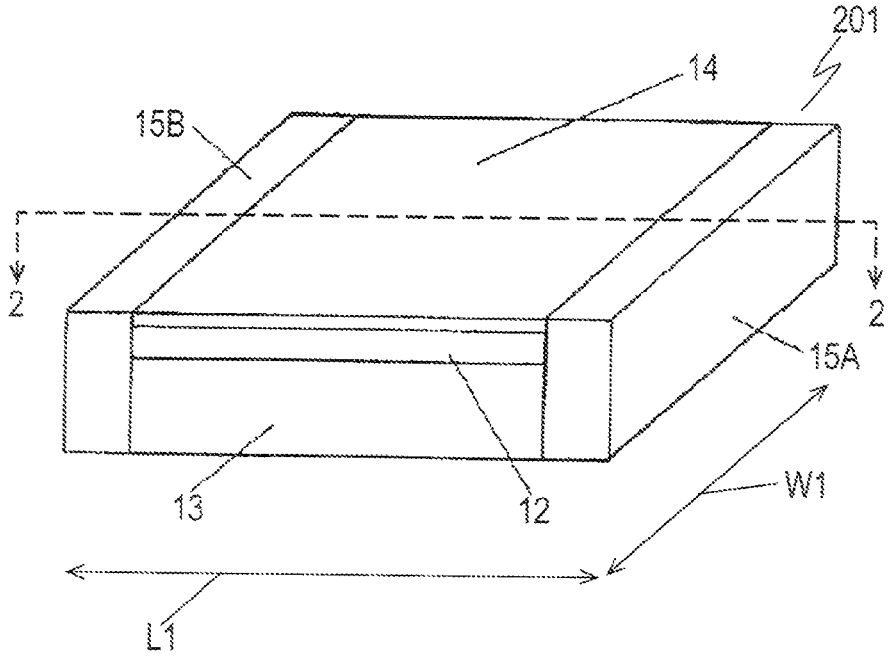
FIG. 1 is a perspective view of a varistor according to Exemplary Embodiment 1 of the present invention.
Figure 2:
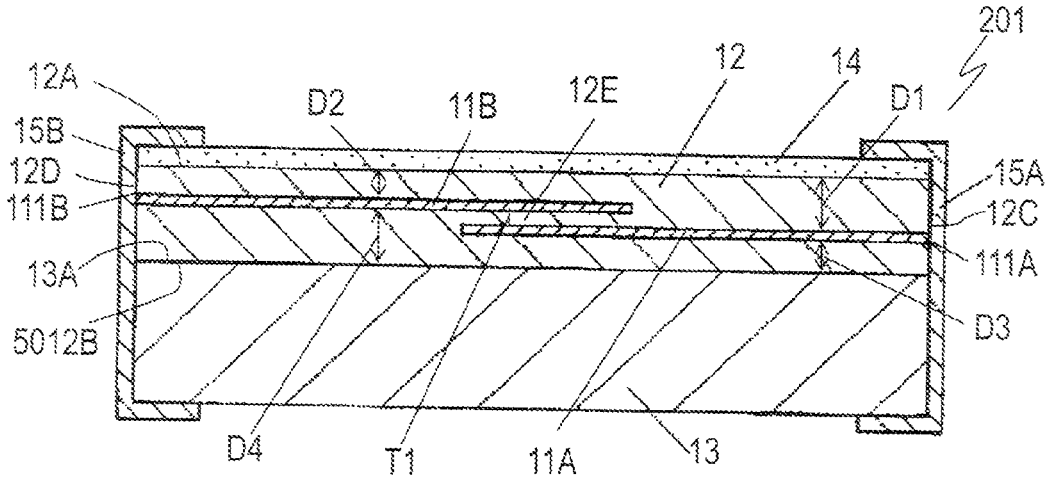
FIG. 2 is a cross-sectional view of the varistor at line 2-2 shown in FIG. 1.

FIG. 1 is a perspective view of a varistor 201 according to Exemplary Embodiment 1 of the present invention. FIG. 2 is a cross-sectional view of the varistor 201 at line 2-2 shown in FIG. 1. The varistor 201 includes a ceramic substrate 13, a varistor layer 12 provided on a surface 13A of the ceramic substrate 13, and a glass ceramic layer 14 provided on a surface 12A of the varistor layer 12. A surface 5012B of the varistor layer 12 opposite to the surface 12A contacts the surface 13A of the ceramic substrate 13. The ceramic substrate 13 is made of material, such as alumina, which gas a resistance to heat and an insulating property. Internal electrodes 11A and 11B facing each other are provided in the varistor layer 12. That is, the varistor layer 12 is provided between the glass ceramic layer 14 and the ceramic substrate 13. Ends 111A and 111B of the internal electrodes 11A and 11B expose to outside on end surfaces 12C and 12D of the varistor layer 12, respectively. The ends 111A and 111B of the internal electrodes 11A and 11B are connected to external electrodes 15A and 15B exposing to outside of the varistor 201, respectively, thus providing the varistor 201 of a surface-mount type.

The varistor layer 12 contains varistor material containing more than 80% by weight of zinc oxide, as a main component, and 0% to 20% by weight of the total of bismuth oxide, antimony oxide, manganese oxide, and cobalt oxide. This composition provides the varistor layer with preferable varistor characteristics. Additive, such as glass, is added to this composition to provide the varistor material which can be baked at about 900° C. The additive may be other material so long as the material has preferable varistor characteristics.

The varistor layer 12 is stacked on the ceramic substrate 13 having a large mechanical strength. Hence, even if the varistor layer 12 has a small mechanical strength, the varistor 201 may have a small thickness.

The glass ceramic layer 14 provided on the surface 12A of the varistor layer 12 prevents the additive, such as bismuth, from evaporating during the baking of the varistor material. Thus, even if being thin, the varistor layer 12 has preferable varistor characteristics and reliability. As the result, the varistor 201 has a small thickness while having preferable varistor characteristics to small surge voltages and reliability.

The ceramic substrate 13 may provide a varistor array including plural varistors.

A method of manufacturing the varistor 201 will be described below.

First, powder of the varistor material, resin binder, plasticizer, and solvent are mixed and dispersed, thereby providing ceramic slurry. Ceramic green sheets having a thickness of about 50 μm are prepared from the slurry by a doctor blade method. Conductive paste mainly containing sliver is applied onto the ceramic green sheets by a screen printing to deposit the internal electrodes 11A and 11B. The ceramic green sheets are stacked such that the internal electrodes 11A and 11B face each other across a portion 12E of the varistor layer 12, as shown in FIG. 2.

The internal electrodes 11A and 11B have areas ranging preferably from 0.3 to 0.5 $mm^2$ and are apart from each other preferably by a distance T1 ranging from 5 to 50 μm so as to provide the varistor 201 of a surface-mount type having a length L1 of 1.0 mm and a width W1 of 0.5 mm.

A ceramic green sheet made of glass ceramic material to be the glass ceramic layer 14 is stacked on the surface 12A of the varistor layer 12, thereby forming a laminated body. The glass ceramic material can be sintered at a baking temperature identical to that of the varistor material. The glass ceramic material may be mixture at 50:50 of alumina ceramic powder and calcium borosilicate/aluminum/glass powder so long as it can be sintered substantially at a baking temperature identical to a temperature at which the varistor material is sintered.

An adhesive, such as acrylic resin dissolved in toluene is applied onto the surface 5012B of the varistor layer 12, on which the glass ceramic layer 14 is not provided, so as to bond the surface 5012B to the surface 13A of the ceramic substrate 13 having a thickness of 0.33 mm made of alumina substrate having a purity of 96%. Then, a pressure of 100 $kg/cm^2$ is applied to the laminated body and the ceramic substrate 13 at a temperature of 100° C. for one minute, thereby completely bonding to the ceramic layer 13 to the laminated body. Then, the laminated body is baked in a baking furnace at a temperature of about 550° C. to have baking resin components of the laminated body eliminated, and then, is baked at about 900° C. for two hours to be sintered. This baking process unitarily joints the glass ceramic layer 14, the varistor layer 12, and the ceramic substrate 13 of alumina substrate. Particularly when the varistor material contains bismuth compound, such as bismuth oxide, the bismuth oxide diffuses to unitarily joint the glass ceramic layer 14, the varistor layer 12, and the ceramic substrate 13 more securely.

The ceramic substrate 13 is made of alumina substrate having a purity of 96%. The ceramic substrate 13 may contain mainly one of aluminum oxide, zirconium oxide, silicon oxide, and magnesium oxide, which have thermal resistance against temperatures for baking the varistor layer 12 and the glass ceramic layer 14 and do not overreact with the varistor material, thereby having preferable mechanical strength.

The baked laminated body often includes plural varistors arranged in a matrix form for increasing their productivity. The baked laminated body is cut and divided into the varistors of chip forms with a cutter, such as a dicing machine. The varistor 201, the divided varistor of the chip form, includes the ends 111A and 111B of the internal electrodes 11A and 11B exposing at the end surfaces 12C and 12D of the varistor layer 12, respectively. Conductive paste, such as sliver paste, is applied onto the end surfaces 12C and 12D of the varistor layer 12 at which the electrode ends 111A and 111B expose, and baked at a predetermined temperature to form external electrodes 15A and 15B, thus providing the varistor 201.

Figures 3A, 3B, 3C, 3D, 3E:
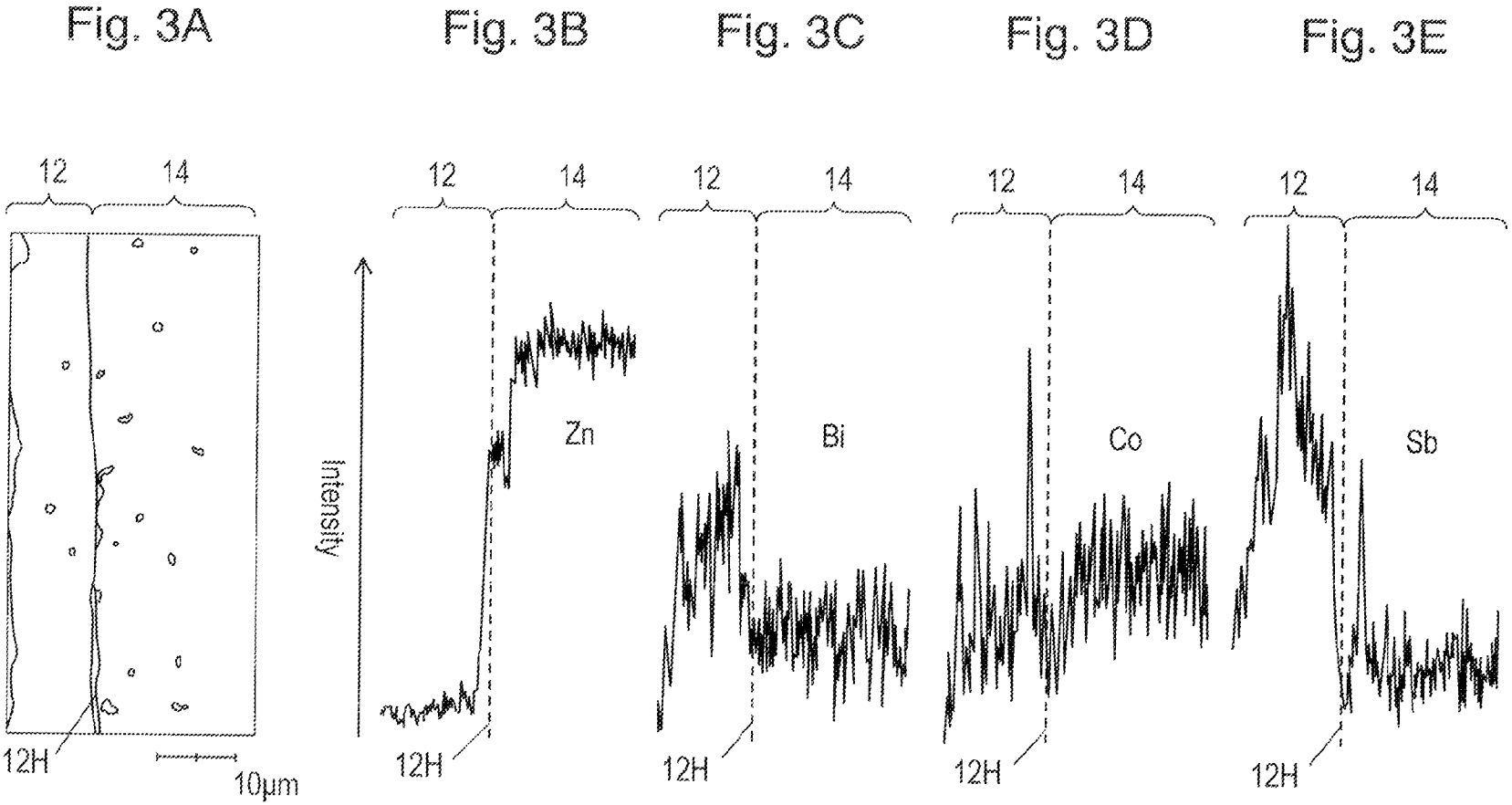
FIG. 3A is a cross-sectional view of the varistor according to Embodiment 1.
FIG. 3B shows a distribution of an element composing the varistor according to Embodiment 1.
FIG. 3C shows a distribution of an element composing the varistor according to Embodiment 1.
FIG. 3D shows a distribution of an element composing the varistor according to Embodiment 1.
FIG. 3E shows a distribution of an element composing the varistor according to Embodiment 1.

Samples of the varistor 201 were manufactured by the above method. The sample according to Embodiment 1 has the distance T1 of about 25 μm between the internal electrodes 11A and 11B. This sample was sliced and had its cut surface polished. Then, the varistor layer 12 and the glass ceramic layer 14 were observed with a scan-type electron microscope. FIG. 3A illustrates the cut surface of the sample varistor 201 showing a micro structure of the interface 12H between the varistor layer 12 and the glass ceramic layer 14. FIGS. 3B to 3E shows profiles of the distribution of zinc (Zn), bismuth (Bi), cobalt (Co), and antimony (Sb) around the interface 12H between the varistor 12 and the glass ceramic layer 14, measured with an energy dispersion type fluorescent X-ray apparatus, respectively.

As shown in FIGS. 3B to 3E, zinc (Zn), as the main component of the varistor material, exists only in the varistor layer 12, and does not exists substantially in the glass ceramic layer 14. Bismuth (Bi), cobalt (Co), and antimony (Sb), the additives, diffuse to the glass ceramic layer 14 and into the inside of the glass ceramic layer 14.

A comparative sample was manufactured by the same method. In this comparative sample, the varistor layer 12 was not protected with the glass ceramic layer 14 but exposes to the outside of the sample. The distance T1 of the comparative sample was about 38 μm.

FIG. 4A shows measurement results of varistor characteristics of the sample of the varistor 201 and the comparative sample. FIG. 4A shows voltages between the external electrodes 15A and 15B when currents of 1 mA, 0.1 mA, 0.01 mA, and 0.001 mA were applied to the samples.

As shown in FIG. 4A, the voltage of the comparative sample is higher than the sample of this embodiment. A sample having a large ratio of voltage V at the current of 1 mA to voltage V at the current of 0.1 mA has preferable non-linearity, accordingly having a preferable varistor characteristic. The sample of this embodiment has non-linearity more preferable than that of the comparative sample.

FIG. 4B illustrates electric characteristics of the samples measured after the samples were placed in a container at the temperature of 85° C. and the humidity of 85% for twenty four hours.

As shown in FIG. 4B, the varistor voltage of the sample of the embodiment does not substantially change before and after the placing while the varistor voltage and the non-linearity of the comparative sample significantly declines.

The comparative sample has the varistor material which is not sufficiently baked, accordingly having the high voltage. When the comparative sample was placed in the container, the varistor material absorbed water to lower the varistor voltage and to have the non-linearity decline. This may result from migration of the additives, such as bismuth oxide, cobalt oxide, and antimony oxide, in the comparative sample into the atmosphere during the baking process. In particular, bismuth oxide is important oxide which allows the varistor layer mainly containing zinc oxide to exhibit the varistor characteristic. Bismuth oxide has a low boiling temperature, accordingly being dispersed easily. Bismuth oxide in the comparative sample was dispersed a lot into the atmosphere during the baking process, and thus, a predetermined amount of bismuth oxide was not contained in the varistor layer 12 or had variations in its content. Thus, it is considered that the comparative sample was sintered insufficiently, accordingly being prevented from having preferable varistor characteristic.

In the sample of the embodiment, the additive, such as bismuth oxide, diffuses a little into the glass ceramic layer 14 during the baking process. However, if the amount of bismuth oxide contained in the glass ceramic layer 14 exceeds a certain value, the bismuth oxide is saturated, and hence, is prevented from diffusing from the varistor layer 12 to the glass ceramic layer 14 after being saturated. Thus, a necessary amount of bismuth oxide remains surely in the varistor layer 12 and allows the varistor layer 12 to be baked sufficiently, thereby providing desired electric characteristics.

If the thickness of the glass ceramic layer 14 exceeds 50 μm after the baking process, an excessive amount of bismuth oxide diffuses into the glass ceramic layer 14. This prevents the varistor layer 12 from being baked sufficiently, and accordingly, may cause deterioration of the varistor characteristic and declination of its property due to the placing in the high temperature and high humidity. If the thickness of the glass ceramic layer 14 after the baking process is smaller than 5 μm, the additive, such as bismuth oxide, diffuses and accordingly causes the glass ceramic layer 14 to have a small electrical resistance. Plated layers made of nickel, tin, or gold may be formed on the external electrodes 15A and 15B to improve the reliability of the external electrodes 15A and 15B. If the glass ceramic layer 14 has a small electrical resistance, the plated layers may unpreferably be formed on the glass ceramic layer 14. The thickness of the glass ceramic layer 14 ranges preferably from 5 to 50 μm. The glass ceramic layer 14 having such thickness is stacked on the varistor layer 12 to provide the varistor 201 with preferable varistor characteristic, preferable reliability, a small size, and a low profile.

The composition, particularly the concentration of the additive, at the interface 12H between the varistor layer 12 and the glass ceramic layer 14 is not uniform, as shown in FIGS. 3B to 3E, accordingly causing the varistor layer 12 to have an unstably status. This status is less stable than that at the interface between the varistor layer 12 and the ceramic substrate 13.

It is not preferable that the varistor characteristic appears at these interfaces and the vicinity thereof Thus, it is preferable that the internal electrodes 11A and 11B are not provided at the interface 12H between the varistor layer 12 and the glass ceramic layer 14 and the vicinity thereof or at the interface between the varistor layer 12 and the ceramic substrate 13 and the vicinity thereof From the results shown in FIGS. 3B to 3E, the internal electrodes 11A and 11B in the varistor layer 12 are apart by a distance not less than 10 μm from the surfaces 5012B and 12A of the varistor layer 12, respectively. That is, the distances D1 and D2 of the internal electrodes 11A and 11B from the surface 12A of the varistor layer 12 are preferably not smaller than 10 μm. The distances D3 and D4 of the internal electrodes 11A and 11B from the surface 5012B of the varistor layer 12 are preferably not smaller than 10 μm.

A diffusion-protesting layer may be provided at the interface 12H between the varistor layer 12 and the glass ceramic layer 14 or at the interface between the varistor layer 12 and the ceramic substrate 13 for preventing bismuth oxide from diffusing, thereby increasing bonding strength at the interface. The diffusion-protesting layer may preferably contain bismuth oxide.

Exemplary Embodiment 2

Figure 5:
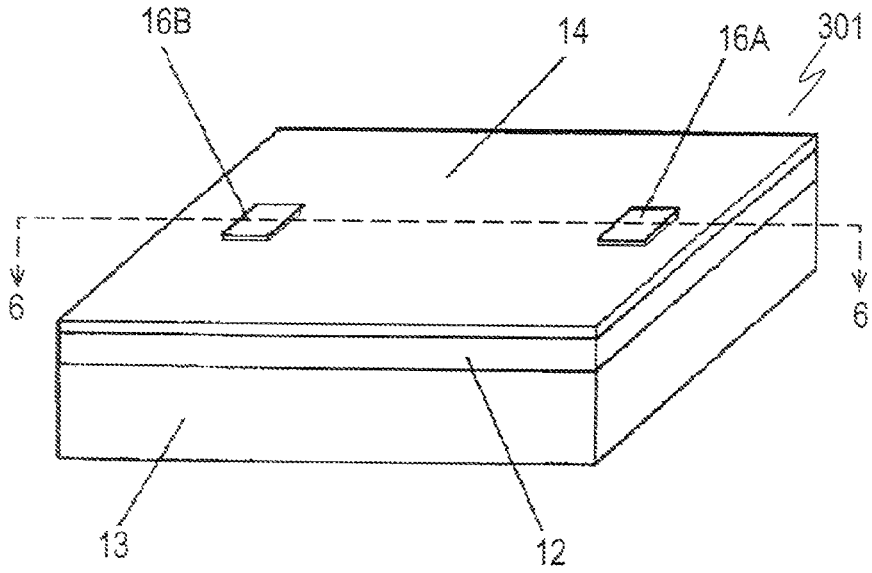
FIG. 5 is a perspective view of a varistor according to Exemplary Embodiment 2 of the invention.
Figure 6:
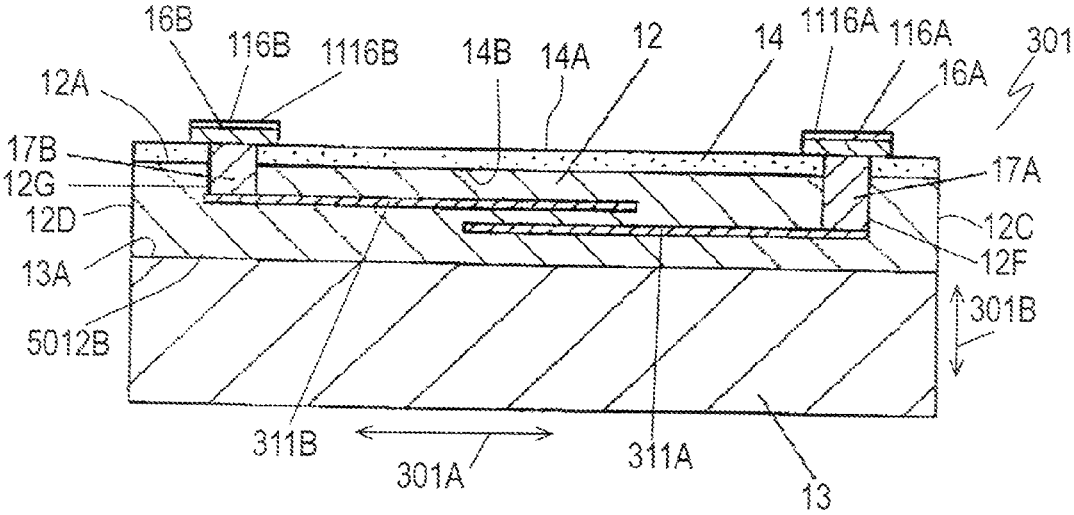
FIG. 6 is a cross-sectional view of the varistor at line 6-6 shown in FIG. 5.

FIG. 5 is a perspective view of a varistor 301 according to Exemplary Embodiment 2 of the present invention. FIG. 6 is a cross-sectional view of the varistor 301 at line 6-6 shown in FIG. 5. The same components as those of the varistor 201 of Embodiment 1 shown in FIGS. 1 and 2 will be denoted by the same reference numerals, and their detail description will be omitted. The varistor 301 includes internal electrodes 311A and 311B facing each other instead of the internal electrodes 11A and 11B of the varistor 201 according to Embodiment 1. The internal electrodes 311A and 311B do not expose at the end surfaces 12C and 12D of the varistor layer 12. The glass ceramic layer 14 has a surface 14B and a surface 14A opposite to the surface 14B. The surface is provided on the surface 12A of the varistor layer 12. The varistor 301 includes terminal electrodes 16A and 16B, external electrodes which expose to the outside of the varistor 301 and are on the surface 14A of the glass ceramic layer 14. The terminal electrodes 16A and 16B are connected across via-hole electrodes 17A and 17B to the internal electrodes 311A and 311B, respectively.

The terminal electrodes 16A and 16B provided on the surface 14A of the glass ceramic layer 14 allows another component to be surface-mounted on the surface 14A. The varistor 301 may be surface-mounted on a circuit board while causing the surface 14A to face the circuit board, hence allowing the terminal electrodes 16A and 16B to be connected directly to circuit patterns on the circuit board. This arrangement allows the circuit board to have components mounted thereon densely, and increase reliability of the connection between the varistor 301 and the circuit board to sagging, twisting, and dropping.

The terminal electrodes 16A and 16B are formed by applying conductive paste onto the surface 14A of the glass ceramic layer 14. The via-hole electrodes 17A and 17B are formed by filling via-holes 12F and 12G with conductive paste, respectively. During the above processes, if the conductive paste is of an ordinary type, it may cause fault, for example, large holes around about the via-hole electrodes 17A and 17B, or cracks around the terminal electrodes 16A and 16B.

Such fault may be caused for the following reasons. In the varistor 301, the varistor layer 12 and the glass ceramic layer 14 are bonded to the ceramic substrate 14, and then, baked. During this baking process, the ceramic substrate 13 does not shrink so much, and accordingly, prevents the varistor layer 12 and the glass ceramic layer 14 from shrinking along a direction 301A parallel to the surface 13A of the varistor layer 12, thus allowing the varistor layer 12 and the glass ceramic layer 14 to shrink only along a thickness direction 301B perpendicular to the surface 12A. The conductive paste to become the terminal electrodes 16A and 16B and the via-hole electrodes 17A and 17B shrinks in both the directions 301A and 301B during the baking process, thereby producing the fault. The conductive paste starts shrinking at a temperature lower than temperatures at which the glass ceramic layer 14 and the varistor layer 12 start shrinking. The conductive paste, upon starting shrinking, applies a force for causing the varistor layer 12 and the glass ceramic layer 14 to shrink in the direction 301A. This force may produce the fault in the varistor layer 12 and the glass ceramic layer 14 which are not sintered and consequently have small mechanism strength.

Molybdenum trioxide is added to the conductive paste in order to raise the temperature at which the conductive paste for the terminal electrodes 16A and 16B and the via-hole electrodes 17A and 17B starts shrink and to increase the strength for bonding the terminal electrodes 16A and 16B and the via-hole electrodes 17A and 17B to the varistor layer 12 and the glass ceramic layer 14. The conductive paste contains metallic powder, such as silver powder, and 0.5% by weight of molybdenum trioxide for the metallic powder. The melting point of molybdenum trioxide is substantially 800° C. Molybdenum trioxide is dispersed as solids between particles of the metallic powder at a temperature not higher than 600° C., at which the varistor layer 12 and the glass ceramic layer 14 are not sintered, and prevents the conductive paste from shrinking. If the temperature exceeds 650° C., a part of the molybdenum trioxide starts melting and diffusing, and then, migrates from the conductive paste to the varistor layer 12 or the interface between the varistor layer 12 and the glass ceramic layer 14. A part of molybdenum trioxide exposing to the outside is sublimated. Simultaneously, another part of molybdenum trioxide reacts with the glass ceramic layer 14 and the varistor layer 12 and functions as a bonding material for bonding the terminal electrodes 16A and 16B to the glass ceramic layer 14 and for bonding the via-hole electrodes 17A and 17B to both the glass ceramic layer 14 and the varistor layer 12. At the temperature at which this reaction occurs, the varistor 12 and the glass ceramic layer 14 start shrink due to the baking process, and have physical strength increase accordingly. Upon the molybdenum trioxide migrating from the inside of the conductive paste, the terminal electrodes 16A and 16B and the via-hole electrodes 17A and 17B are baked and shrink.

The amount of the molybdenum trioxide added may be adjusted to control the temperature at which the conductive paste starts shrinking, so that the conductive paste starts shrinking at the temperature substantially identical to a temperature at which the layers 12 and 14 start shrinking. Thus, the terminal electrodes 16A and 16B, the via-hole electrodes 17A and 17B, the varistor layer 12, and the glass ceramic layer 14 can be baked and shrink along the thickness direction 301B at the same temperature. Consequently, the conductive paste can be baked and shrink without creating the fault, such as holes or cracks around the terminal electrodes 16A and 16B and the via-hole electrodes 17A and 17B. When the temperature rises to 800° C., molybdenum trioxide starts melting and sublimated. Molybdenum trioxide may remain partially in the conductive paste. A part of the remaining molybdenum trioxide increases bonding strength at the interfaces between the glass ceramic layer 14 and the terminal electrodes 16A and 16B and at the interfaces between the via-hole electrodes 17A and 17B and the varistor layer 12 and the glass ceramic layers 14.

A small amount of molybdenum trioxide may be added into the internal electrodes 311A and 311B in order to avoid the above fault caused by shrinkage during the baking process.

Molybdenum trioxide may be added into the conductive paste for forming the terminal electrodes 16A and 16B, thereby preventing the oxides, the additive added to the varistor layer 12 and glass components of the glass ceramic layer 14 from diffusing and migrating. Consequently, the oxides or glass components do not exist on the surfaces 116A and 116B of the terminal electrodes 16A and 16B. Plated layers 1116A and 1116B made of metal, such as nickel, tin, or gold, may be provided on the terminal electrodes 16A and 16B for improving reliability. Since oxides or glass components do not exist on the surfaces 116A and 116B of the terminal electrodes 16A and 16B, the plated layers 1116A and 1116B can be formed uniformly and easily.

The amount of molybdenum trioxide added to the conductive paste for forming the terminal electrodes 16A and 16B and the via-hole electrodes 17A and 17B is not less than 0.5% by weight for the metallic powder contained in the conductive paste, thereby increasing effects for reducing the fault. If this amount exceeds 5% by weight, an amount of molybdenum trioxide may remain in the terminal electrodes 16A and 16B and the via-hole electrodes 17A and 17B. The remaining molybdenum trioxide increases the electrical resistance of the terminal electrodes 16A and 16B and the via-hole electrodes 17A and 17B. Further, molybdenum trioxide may appear on the surfaces 116A and 116B of the terminal electrodes 16A and 16B and prevent the plated layers 1116A and 1116B from being formed.

Figure 7A:
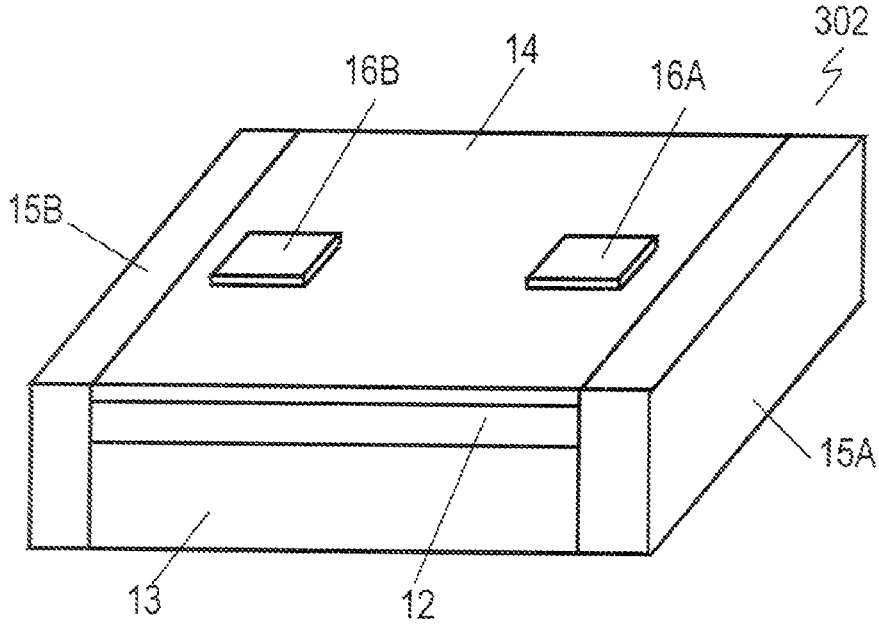
FIG. 7A is a perspective view of another varistor according to Embodiment 2.

FIG. 7A is a perspective view of another varistor 302 according to Embodiment 2. The varistor 302 includes the varistor 301 shown in FIGS. 5 and 6 and the external electrodes 15A and 15B of the varistor 201 shown in FIGS. 1 and 2. The varistor 302 includes the internal electrodes 11A and 11B of the varistor 201 shown in FIG. 2 instead of the internal electrodes 311A and 311B of the varistor 301. That is, in the varistor 302, the terminal electrodes 16A and 16B are connected to the internal electrodes 11A and 11B, respectively, while the external electrodes 15A and 15B are connected to the internal electrodes 11A and 11B, respectively. Thus, the terminal electrodes 16A and 16B of the varistor 302 are connected via the internal electrodes 11A and 11B to the external electrodes 15A and 15B, respectively.

Figure 7B:
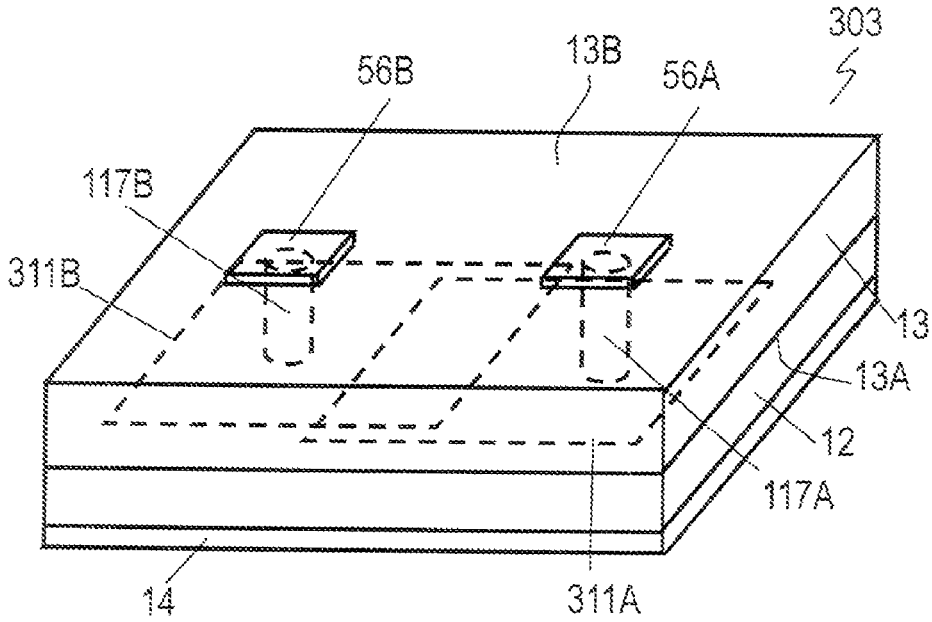
FIG. 7B is a perspective view of a further varistor according to Embodiment 2.

FIG. 7B is a perspective view of a further varistor 303 according to Embodiment 2. The varistor 303 includes terminal electrodes 56A and 56B instead of the terminal electrodes 16A and 16B of the varistor 301 shown in FIGS. 5 and 6, respectively. The terminal electrodes 56A and 56B are external electrodes provided on the surface 13B of the ceramic substrate 13 opposite to the surface 13A, and expose to the outside of the varistor 303. The varistor 303 includes, instead of the via-hole electrodes 17A and 17B, via-hole electrodes 117A and 117B embedded in the varistor layer 12 and the ceramic substrate 13. The via-hole electrodes 117A and 117B are connected to internal electrodes 311A and 311B in the varistor layer 12, respectively. The terminal electrodes 56A and 56B exposing at the surface 13B of the ceramic substrate 13 are connected to the portions of the via-hole electrodes 117A and 117 exposing at the surface 13B, respectively.

Figure 7C:
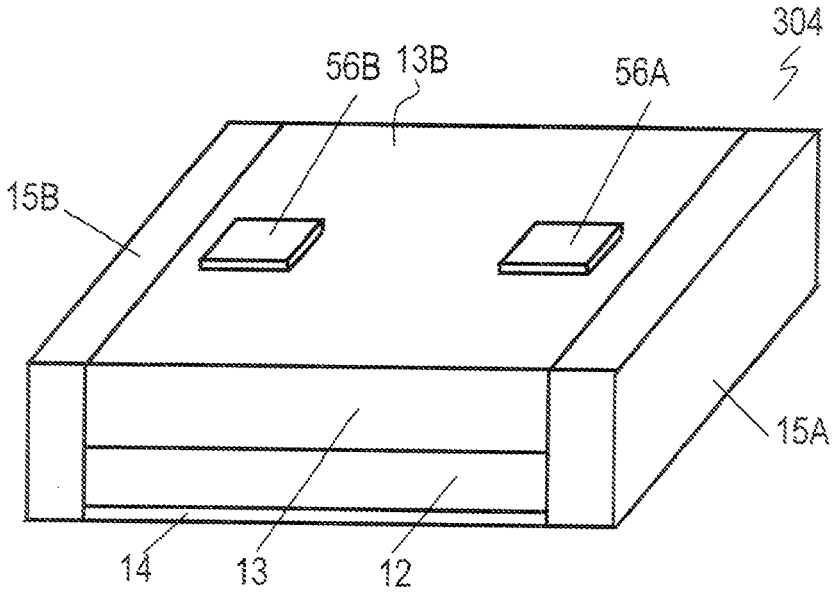
FIG. 7C is a perspective view of a still further varistor according to Embodiment 2.

FIG. 7C is a perspective view of a still further varistor 304 according to Embodiment 2. The varistor 304 includes the varistor 303 shown in FIG. 7B and the external electrodes 15A and 15B of the varistor 201 shown in FIGS. 1 and 2. The varistor 304 includes, instead of the internal electrodes 311A and 311B of the varistor 303, the internal electrodes 11A and 11B of the varistor 201 shown in FIG. 2. That is, the terminal electrodes 56A and 56B are connected to the internal electrodes 11A and 11B of the varistor 304, respectively. The external electrodes 15A and 15B are connected to the internal electrodes 11A and 11B, respectively. Thus, in the varistor 304, the terminal electrodes 56A and 56B are connected electrically via the internal electrodes 11A and 11B to the external electrodes 15A and 15B, respectively.

Exemplary Embodiment 3

Figure 8:
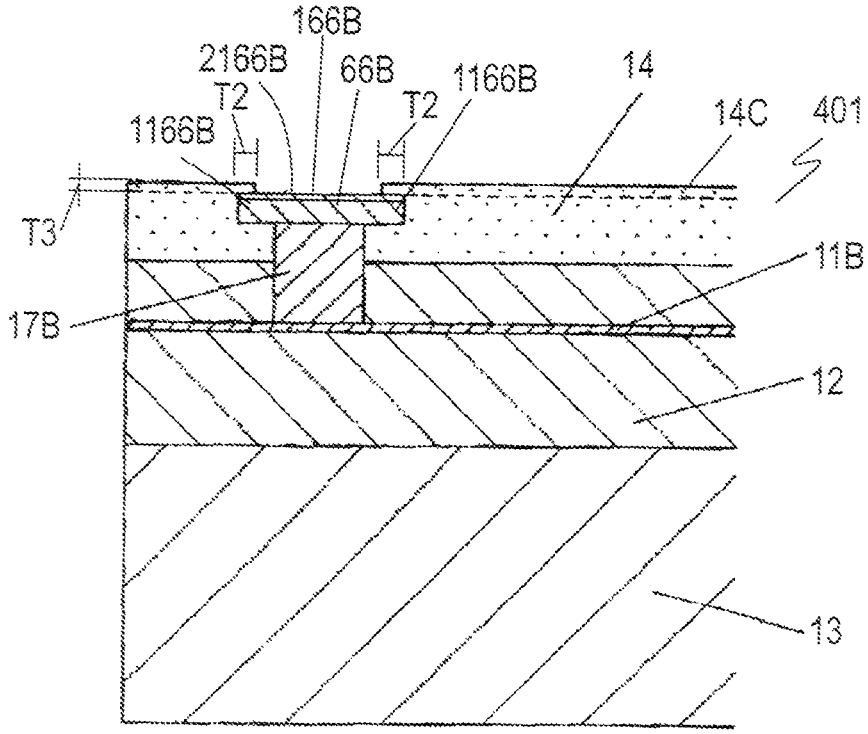
FIG. 8 is an enlarged cross-sectional view of a varistor according to Exemplary Embodiment 3 of the invention.

FIG. 8 is an enlarged cross-sectional view of a varistor 401 according to Exemplary Embodiment 3 of the present invention. The same components as those of the varistor 301 of Embodiment 2 shown in FIGS. 5 and 6 will be denoted by the same reference numerals, and their detail description will be omitted.

Potable electronic apparatuses need to have resistance to physically-hostile conditions, such as dropping. Components, such as a varistor, in the electronic apparatuses need to have physical strength against sagging, twisting, or dropping of a circuit board having the components mounted thereon.

The varistor 401 includes a terminal electrode 66B, an enternal electrode exposing to the outside of the varistor 401 instead of the terminal electrode 16B of the varistor 301 of Embodiment 2 shown in FIG. 5 and 6. The terminal electrode 66B is embedded in the glass ceramic layer 14 and has a surface 166B exposing from the glass ceramic layer 14. The varistor 401 includes, instead of the terminal electrode 16A of the varistor 301 of Embodiment 2, a terminal electrode having a shape similar to the electrode 66B. A glass ceramic layer 14C covers the periphery 1116B of the surface 166B of the terminal electrode 66B, and increases physical strength of the terminal electrode 66B.

The glass ceramic layer 14C covering the periphery 1116B of the terminal electrode 16B preferably has a width not smaller than 20 μm, and provides the terminal electrode 66B with practically-sufficient strength against impact. The width T2 is preferably not greater than 100 μm in consideration to the overall dimensions of the components in the electronic apparatus as well as the size and shape of the terminal electrode 66B. The glass ceramic layer 14C preferably has a thickness T3 not smaller than 3 μm, and provides the terminal electrode 66B with practically-sufficient strength. The thickness T3 exceeding 10 μm may cause the glass ceramic layer 14C and the terminal electrode 66B to have undulated surfaces, accordingly preventing the varistor 401 from being surface mounted thereon.

The terminal electrode 66B and the glass ceramic layer 14 of the varistor 401 may be formed by some methods. The terminal electrode 66B is formed on the surface 14A of the glass ceramic layer 14, and then, glass ceramic paste made of glass ceramic material may be printed to form the glass ceramic layer 14C. Alternatively, the terminal electrode 66B may be provided on the surface 14A of the glass ceramic layer 14, and then, a glass ceramic green sheet having a hole slightly smaller than the surface 166B of the terminal electrode 66B is stacked on the surface 14A of the glass ceramic layer 14, thereby providing the glass ceramic layer 14C. The material of the glass ceramic layer 14C is preferably identical to that of the glass ceramic layer 14, but is not limited to it as long as the material reacts not crucially with the glass ceramic layer 14.

In the varistor 401, the periphery 1166B of the terminal electrode 66B having the width T2 of 25 μm is covered with the glass ceramic layer 14C having the thickness T3 of 5 μm. The surface 166B of the terminal electrode 66B has a square shape having an area of 2 $mm^2$. According to a tensile strength test in which a lead wire connected to the terminal electrode 66B is pulled in a direction perpendicular to the surface 166B, the surface has an average tensile strength of 14 kg. On the other hand, a comparative varistor which does not include the glass ceramic layer 14C has an average tensile strength of 6 kg. The varistor 401 according to Embodiment 3 has physical strength twice the strength of the comparative varistor. The terminal electrode formed by printing has a thin periphery and has a small bonding strength to the glass ceramic layer.

The varistor 401 allows the periphery 1166B of the terminal electrode 66B has a large bonding strength. The surface 166B of the terminal electrode 66B having a plated layer 2166B thereon made of metal, such as nickel, tin, or gold, has an average tensile strength of 13 kg. A comparative varistor having the same plated layer has an average tensile strength of 3 kg. In the comparative varistor, plating liquid and cleaning agent, such as acid or alkali solution, enter through a thinner portion of the periphery of the terminal electrode and dissolve the interface between the terminal electrode and the glass ceramic layer, thus decreasing the bonding strength. In the varistor 401, the glass ceramic layer 14V covers the periphery 1166B of the terminal electrode 66B, and prevents the interface between the terminal electrode and the glass ceramic layer from being dissolved.

The glass ceramic layer 14C covers preferably the entire periphery 1166B of the terminal electrode 66B. However, the glass ceramic layer 14C may cover only a portion of the periphery 1166B of the terminal electrode 66B under the condition of the arrangement of the terminal electrode 66B, increasing the tensile strength.

Figure 9:
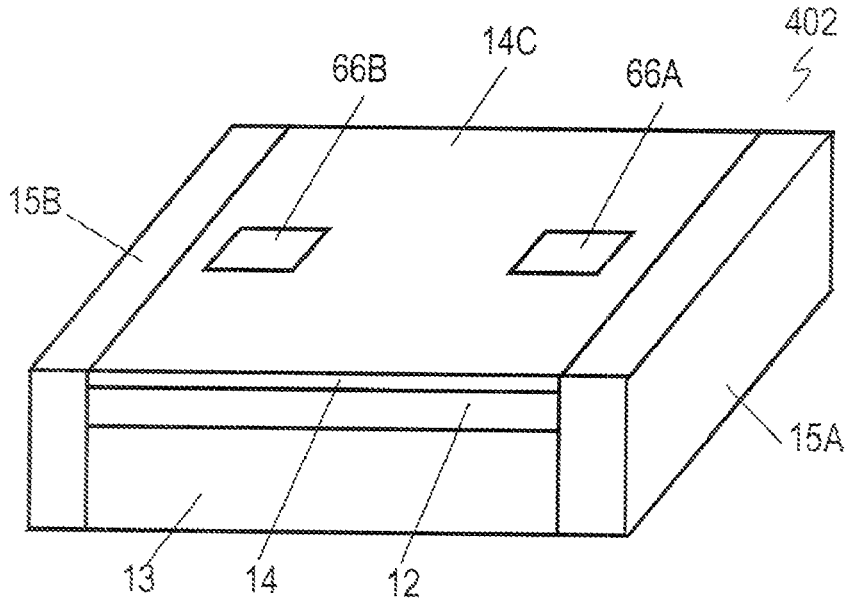
FIG. 9 is a perspective view of another varistor according to Embodiment 3.

FIG. 9 is a perspective view of another varistor 402 according Embodiment 3. The varistor 402 includes varistor 401 shown in FIG. 8 and the external electrodes 15A and 15B of the varistor 201 shown in FIGS. 1 and 2. In the varistor 402, the terminal electrodes 66A and 66B are connected to the internal electrodes 11A and 11B, respectively. The external electrodes 15A and 15B are connected to the internal electrodes 11A and 11B, respectively. Thus, in the varistor 402, the terminal electrodes 66A and 66B are connected via the internal electrodes 11A and 11B to the external electrodes 15A and 15B, respectively.

Exemplary Embodiment 4

Figure 10:
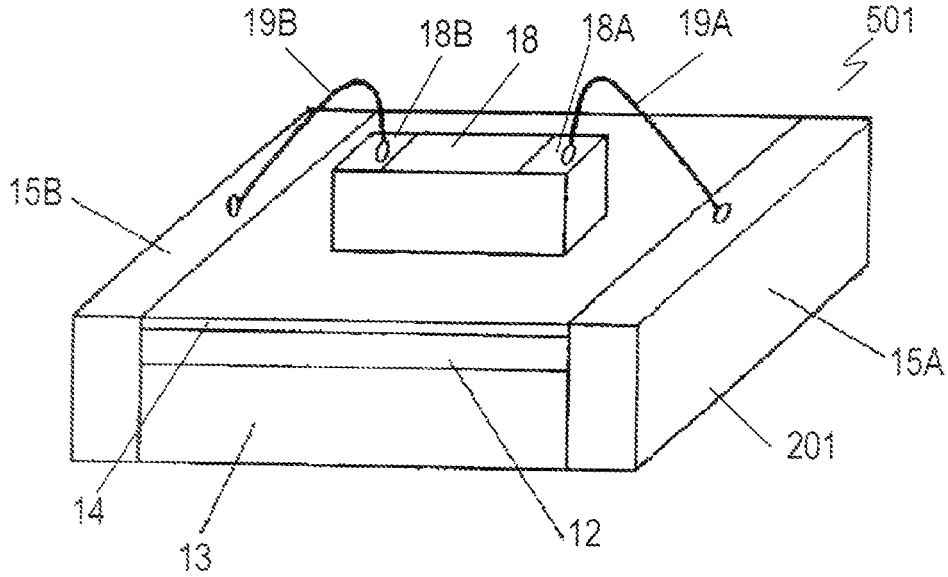
FIG. 10 is a perspective view of an electronic component module according to Exemplary Embodiment 4 of the invention.

FIG. 10 is a perspective view of a light emitting diode (LED) module 501, an electronic component module according to Exemplary Embodiment 4 of the present invention. The LED module 501 includes the varistor 201 of Embodiment 1 and a light emitting diode 18 of white or blue color, an electronic component mounted on the surface 14A of the glass ceramic layer 14 of the varistor 201. Light emitting diodes particularly of white or blue color generate a large amount of heat, and necessarily, have the generated heat dissipated. Hence, the ceramic substrate 13 is preferably made of alumina substrate having purity not smaller than 90% for maintaining its physical strength, heat conductivity, and productivity. The light emitting diode 18 has terminals 18A and 18B. The terminals 18A and 18B are connected to the external electrodes 15A and 15B of the varistor 201 with wires 19A and 19B, respectively, by wire-connection method, such as wire-bonding. The light emitting diode 18 is connected in parallel to a varistor element provided by the internal electrodes 11A and 11B embedded in the varistor layer 12.

Figure 11A:
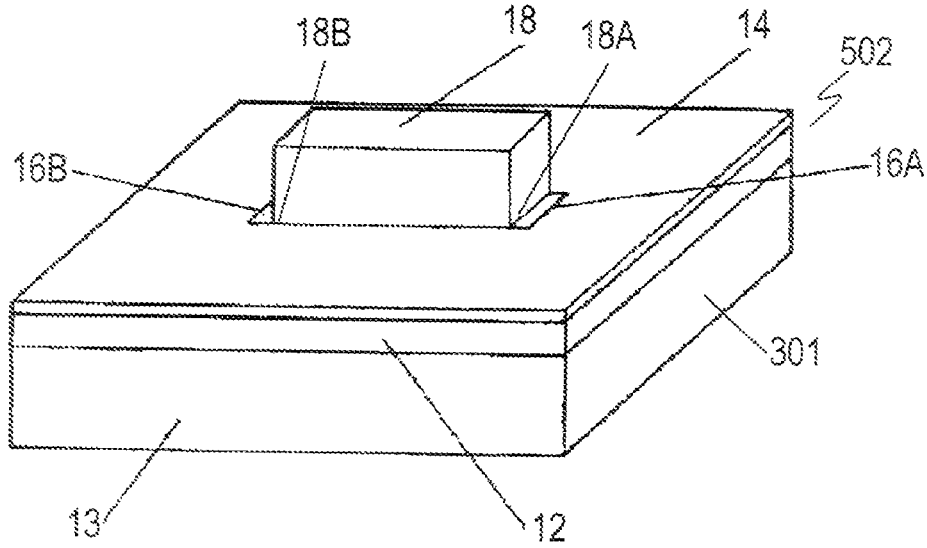
FIG. 11A is a perspective view of another electronic component module according to Embodiment 4.

FIG. 11A is a perspective view of an LED module 502, another electronic component module according to Embodiment 4. The LED module 502 includes, instead of the varistor 201 of the LED module 501 shown in FIG. 10, the varistor 301 according to Embodiment 2. The light emitting diode 18 is mounted on the glass ceramic layer 14. The terminals 18A and 18B are connected to terminal electrodes 16A and 16B, respectively, by a mounting method, such as a solder mounting method or a bump mounting method.

Figure 11B:
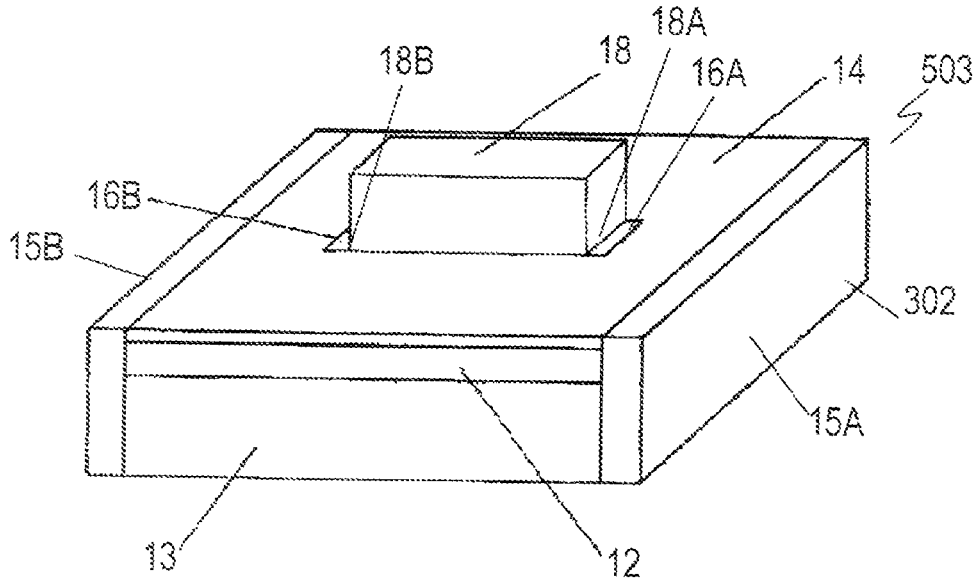
FIG. 11B is a perspective view of a further electronic component module according to Embodiment 4.

FIG. 11B is a perspective view of an LED module 503, a further electronic component module according to Embodiment 4. The LED module 503 includes the varistor 302 shown in FIG. 7A instead of the varistor 301 of the LED module 502 shown in FIG. 11A. The light emitting diode 18 is mounted on the glass ceramic layer 14. The terminals 18A and 18B are connected to terminal electrodes 16A and 16B, respectively, by a mounting method, such as a solder mounting method or a bump mounting method. The external electrodes 15A and 15B allow the LED module 502 to be mounted on a circuit board.

Figure 11C:
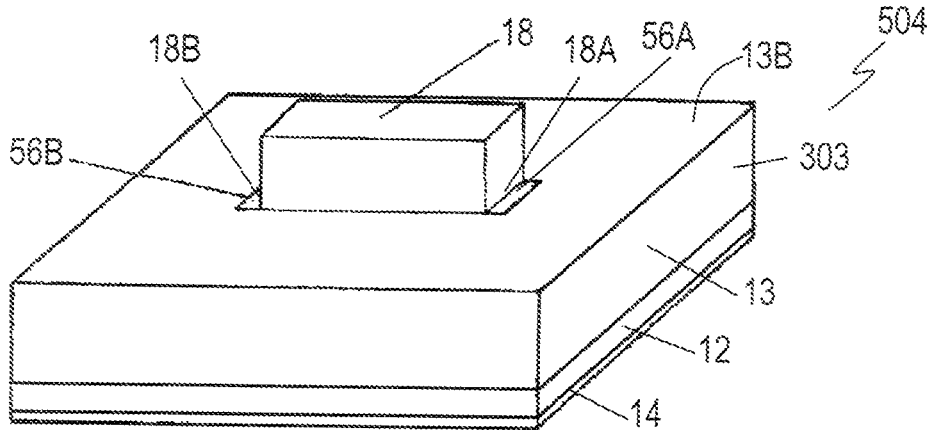
FIG. 11C is a perspective view of a still further electronic component module according to Embodiment 4.

FIG. 11C is a perspective view of an LED module 504, a still further electronic component module according to Embodiment 4. The LED module 504 includes the varistor 303 shown in FIG. 7B instead of the varistor 301 of the LED module 502 shown in FIG. 11A. The light emitting diode 18 is mounted on the surface 13B of the ceramic substrate 13. The terminals 18A and 18B are connected to terminal electrodes 56A and 56B by a mounting method, such as solder mounting method or bump mounting method.

Figure 11D:
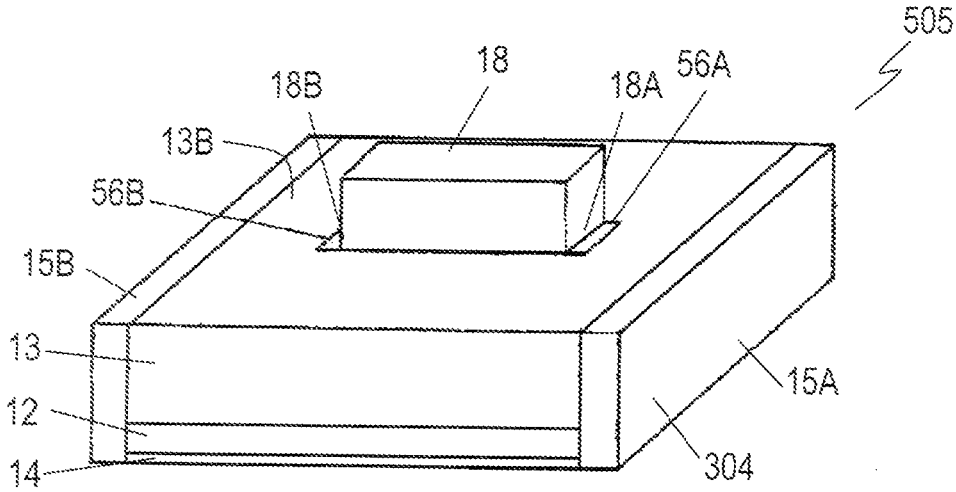
FIG. 11D is a perspective view of a still further electronic component module according to Embodiment 4.

FIG. 11D is a perspective view of an LED module 505, a still further electronic component module according to Embodiment 4. The LED module 505 includes the varistor 304 shown in FIG. 7C instead of the varistor 303 of the LED module 504 shown in FIG. 11C. The light emitting diode 18 is mounted on the glass ceramic layer 14. The terminals 18A and 18B are connected to terminal electrodes 56A and 56B by a mounting method, such as a solder mounting method or a bump mounting method. The external electrodes 15A and 15B allows the LED module 503 to be mounted on a circuit board.

In the LED modules 501 to 505 according to Embodiment 4, the light emitting diode 18 emits light when an ordinary voltage is applied between the terminals 18A and 18B. If a voltage, such as a static surge voltage, higher than the ordinary voltage is applied between the terminals 18A and 18B of the light emitting diode 18, a large current produce by the higher voltage bypasses to the internal electrodes 11A and 11B or to the internal electrodes 311A and 311B facing each other in the varistor layer 12. Thus, the varistor layer 12 protects the light emitting diode 18, and provides the LED modules 501 to 504 with small sizes.

The ceramic substrate 13 having large mechanical strength provides the LED modules 501 to 505 with low profile. Since the light emitting diode 18 is connected to the varistor by a short distance, the LED module according to Embodiment 4 protects the light emitting diode 18 from static pulses having a high voltage.

The LED modules 501 to 505 may include an electronic circuit including resistors, inductors, and capacitors besides the varistor. For example, the LED modules may have various electronic components mounted on the surface 13B of the ceramic substrate 13. This arrangement provides the LED modules with high density.

The electronic component module according to Embodiment 4 includes the light emitting diode 18 as the electronic component, but may include an electronic component, such as a semiconductor device, other than the light emitting diode. The varistor protects the electronic component from static electricity or surge voltage, thus providing a small electronic component module having resistance to the static electricity or surge voltage.

Exemplary Embodiment 5

Figure 12A:
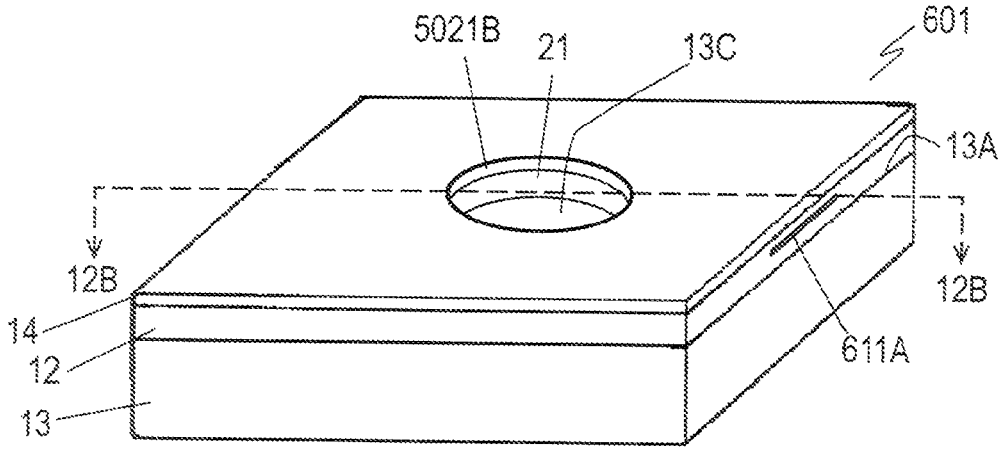
FIG. 12A is a perspective view of a varistor according to Exemplary Embodiment 5 of the invention.
Figure 12B:
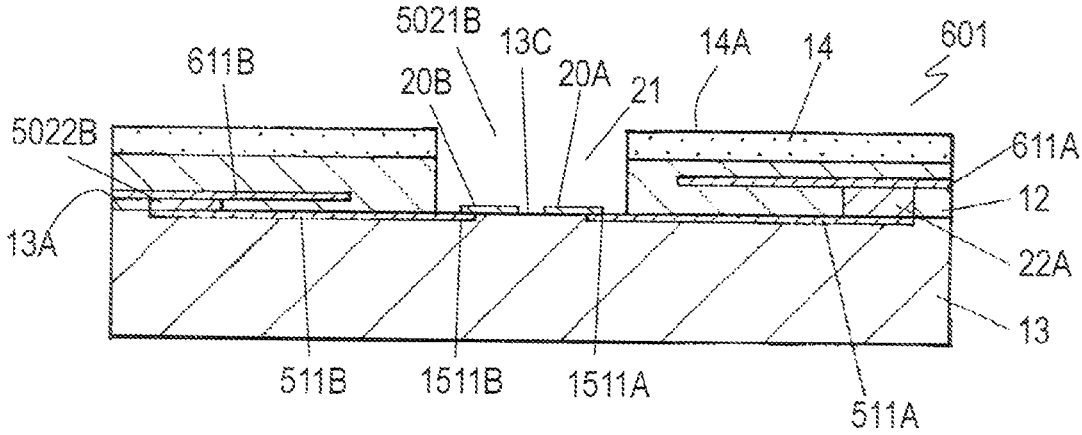
FIG. 12B is a cross-sectional view of the varistor at line 12B-12B shown in FIG. 12A.
Figure 12C:
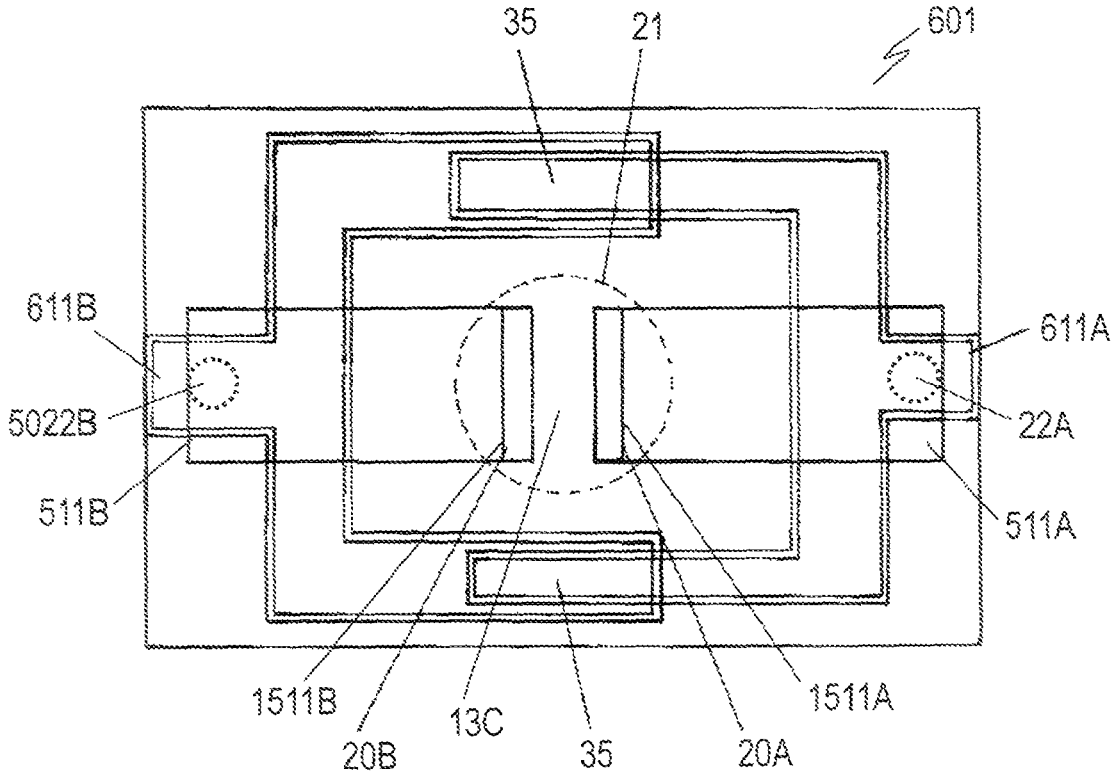
FIG. 12C is a top perspective view of the varistor according to Embodiment 5.
Figure 13:
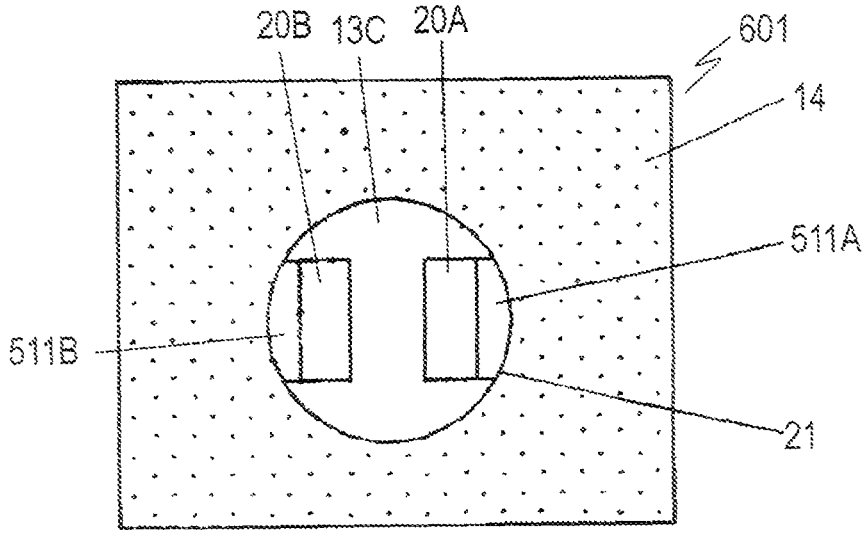
FIG. 13 is a top view of the varistor according to Embodiment 5.

FIG. 12A is a perspective view of a varistor 601 according to Exemplary Embodiment 5 of the present invention. FIG. 12B is a cross-sectional view of the varistor 601 at line 12B-12B shown in FIG. 12A. FIG. 12C is a top perspective view of the varistor 601. FIG. 13 is a top view of the varistor 601. The same components as those of the varistor 201 of Embodiment 1 shown in FIGS. 1 and 2 will be denoted by the same reference numerals, and their detail description will be omitted.

In the varistor 601 according to Embodiment 5, different from the varistor 201 of Embodiment, a hole 21 is provided through the varistor layer 12 and the glass ceramic layer 14 such that a portion 13C of the surface 13A of the ceramic substrate 13 exposes at a bottom of the hole 21. The hole 21 has an opening 5021B opening at the surface 14A of the glass ceramic layer 14. Terminal electrodes 20A and 20B are provided for allowing the portion 13C of the surface 13 to have an electronic component mounted on the portion 13C. The terminal electrodes 20A and 20B are external electrodes exposing to the outside of the varistor 601. Internal electrodes 611A and 611B are provided in the varistor layer 12. Internal electrodes 511A and 511B are provided at the interface between the varistor layer 12 and the ceramic substrate 13, i.e., on the surface 13A of the ceramic substrate 13. The internal electrodes 511A and 511B has ends 1511A and 1511B located on the portion 13C, respectively. The internal electrodes 611A and 611B are connected to the internal electrodes 511A and 511B with via-hole electrodes 22A and 5022B provided in the varistor layer 12, respectively. Terminal electrodes 20A and 20B are provided on the ends 1511A and 1511B of the internal electrodes 511A and 511B exposing hole 21, and are connected to the ends 1511A and 1511B, respectively.

As shown in FIG. 12C, the internal electrodes 611A and 611B face each other across portions 35 of the varistor layer 12, thus allowing the portions 35 to provide the varistor 601 with characteristics as a varistor.

Figure 14:
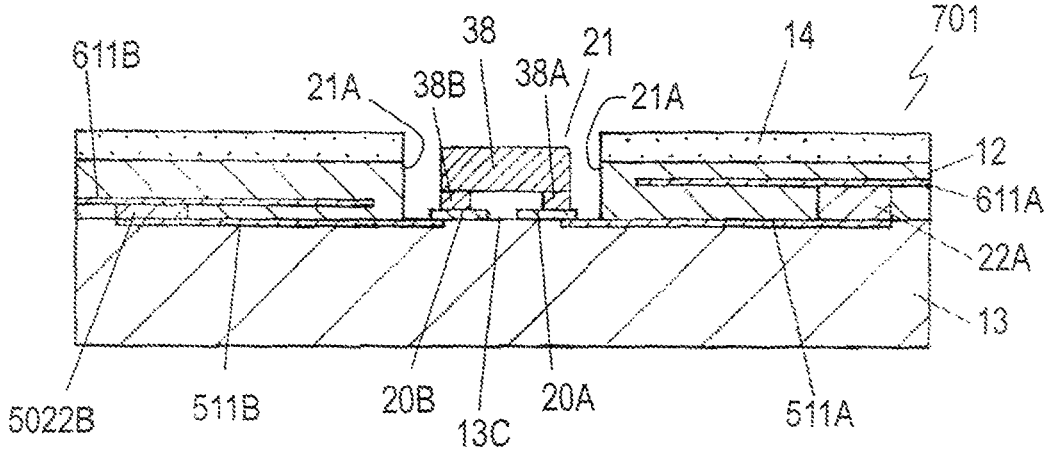
FIG. 14 is a cross-sectional view of an electronic component module including the varistor according to Embodiment 5.

FIG. 14 is a cross-sectional view of a light emitting diode (LED) module 701, an electronic component module according to Embodiment 5. The LED module 701 includes the varistor 601 shown in FIGS. 12A to 12C and 13 and a light emitting diode 38 of white or blue color, an electronic component. Light emitting diodes particularly of white or blue color generate a large amount of heat, and necessarily, have the generated heat dissipated. Hence, the ceramic substrate 13 is preferably made of alumina substrate having purity not smaller than 90% for maintaining its physical strength, heat conductivity, and productivity. The light emitting diode 38 is provided in the hole 21 and has terminals 38A and 38B connected to the external electrodes 20A and 20B, respectively. The light emitting diode 38 is accommodated in the hole 21, consequently allowing the LED module 701 to have a small thickness.

As shown in FIGS. 13 and 14, the hole 21 preferably has a substantially circular shape seen from above. That is, the opening 21 opening in the glass ceramic layer 14 has a substantially circular shape. The circular shape of the hole 21 prevents any fault from appearing at the interface between the hole 21 and the surface 13A of the ceramic substrate 13. Light emitted from the light emitting diode 38 mounted in the hole 21 reflects efficiently on an wall surface 21A of the hole 21, thereby providing light with high intensity.

In the LED module 701, the light emitting diode 38 emits light when an ordinary voltage is applied between the terminals 38A and 38B. If a voltage, such as a static surge voltage, higher than the ordinary voltage is applied between the terminals 38A and 38B of the light emitting diode 38, a large current produce by the higher voltage bypasses to the internal electrodes 511A, 511B, 611A, and 611B facing each other in the varistor layer 12. Thus, the varistor layer 12 protects the light emitting diode 38, and provides the LED module 701 with small sizes.

The ceramic substrate 13 having large mechanical strength provides the LED module 701 with low profile. Since the light emitting diode 38 is connected to the varistor by a short distance, the LED module 701 protects the light emitting diode 38 from static pulses having a high voltage.

The LED module 701 may include an electronic circuit including resistors, inductors, and capacitors besides the varistor. For example, the LED module may include various electronic components mounted on the surface 13B of the ceramic substrate 13. This arrangement provides the LED module with high density.

The electronic component module 701 includes the light emitting diode 38 as the electronic component, but may include an electronic component, such as a semiconductor device, other than the light emitting diode. The varistor protects the electronic component from static electricity or surge voltage, thus providing a small electronic component module having resistance to the static electricity or surge voltage.

Figure 15:
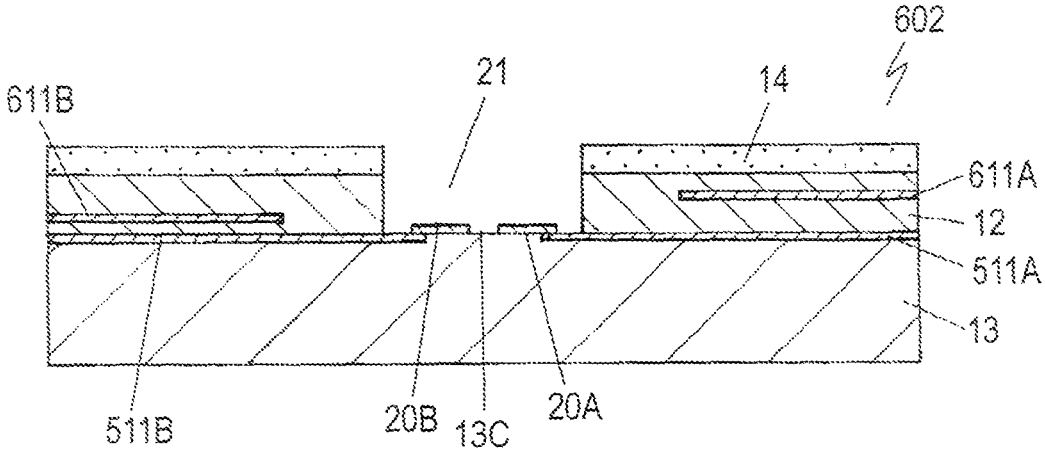
FIG. 15 is a cross-sectional view of another varistor according to Embodiment 5.

FIG. 15 is a cross-sectional view of another varistor 602 according to Embodiment 5. The varistor 602 has a structure identical to that of the varistor 601 shown in FIGS. 12A to 12C, except that the via-hole electrode 22A or 5022B is not provided. The terminal electrodes 20A and 20B are connected electrically in parallel to the internal electrodes 611A and 611B. Even when a high voltage, such as static surge, is applied to the light emitting diode 18, a large current produced by the high voltage is bypassed to the internal electrodes 611A and 611B connected in parallel with the terminal electrodes 20A and 20B, thus protecting the light emitting diode 18.

Figure 16:
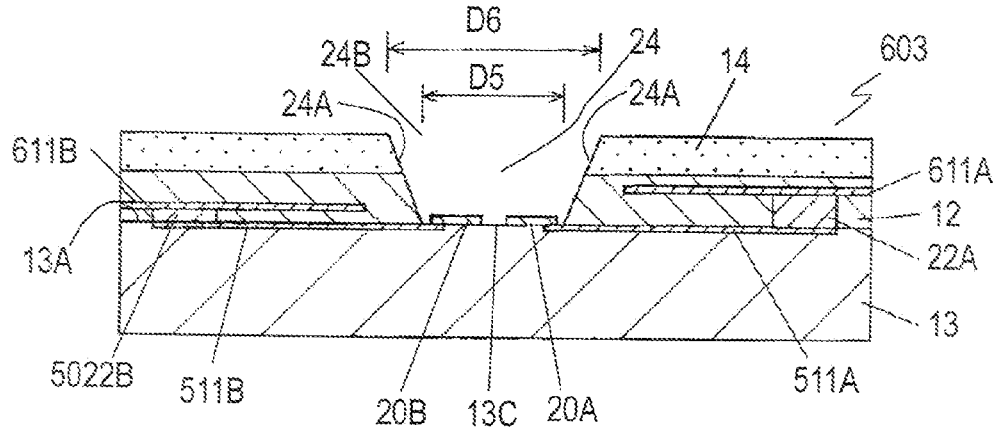
FIG. 16 is a cross-sectional view of a further varistor according to Embodiment 5.

FIG. 16 is a cross-sectional view of a further varistor 603 according to Embodiment 5. While the hole 21 of the varistor 601 shown in FIGS. 12A to 12C and 13 has a substantially circular column shape, the varistor 603 has a hole 24 therein having a taper shape flaring from the varistor layer 12 towards the glass ceramic layer 14.

The diameter D5 of the portion 13C of the surface 13A of the ceramic substrate 13 exposing at the bottom of the hole 21 and the diameter D6 of the opening 24B of the hole 24 in the glass ceramic layer 14 satisfies the relation, D5<D6. An inclining wall surface 24A of the hole 24 allows light emitted from the light emitting diode mounted in the hole 24 to converge in a single direction, thereby providing bright light.

Figure 17:
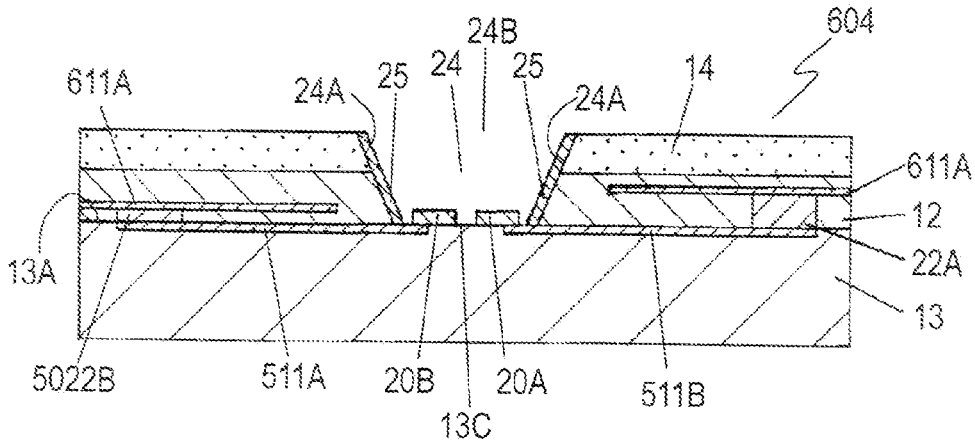
FIG. 17 is a cross-sectional view of a still further varistor according to Embodiment 5.

FIG. 17 is a cross-sectional view of a still further varistor 604 according to Embodiment 5. The varistor 604 further includes a light-reflecting layer 25 provided on the inclining wall surface 24A of the hole 24 shown in FIG. 16. The light-reflecting layer 25 is made of light-reflecting material, such as metal. The light-reflecting layer 25 on the inclining wall surface 24A of the hole 24 allows light emitted from the light emitting diode mounted in the hole 24 to converge in a single direction, thereby providing bright light.

Figure 18:
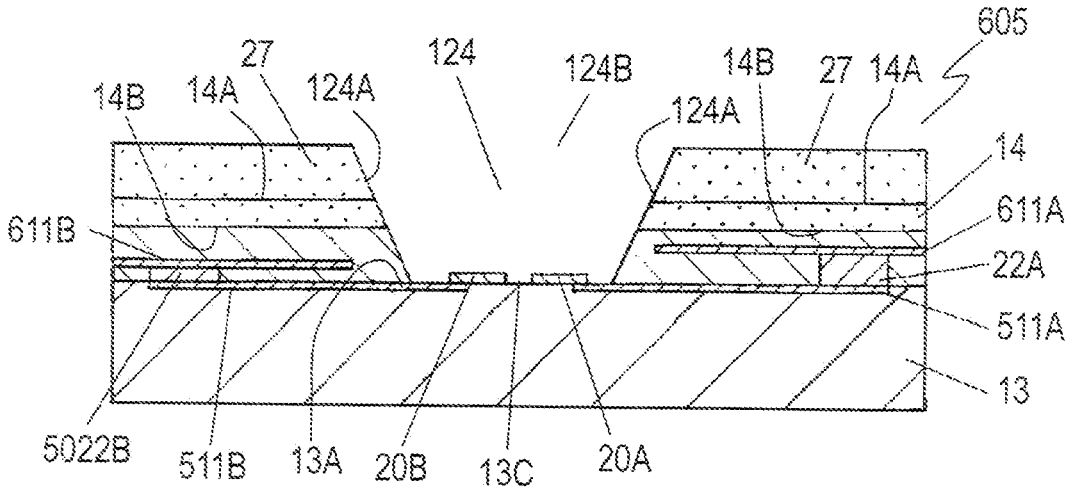
FIG. 18 is a cross-sectional view of a still further varistor according to Embodiment 5.

FIG. 18 is a cross-sectional view of a still further varistor 605 according to Embodiment 5. The varistor 605 further includes glass ceramic layer 27 provided on the surface 14A of the glass ceramic layer 14 of the varistor 603 shown in FIG. 16. The varistor 605 has a hole 124 having an opening 124B opening at glass ceramic layer 14 instead of the hole 24 of the varistor 603 shown in FIG. 16. A surface 14A of the glass ceramic layer 14 opposite to the surface 14A contacts the surface 12A of the varistor layer 12. The glass ceramic layer 27 is made of glass material having a softening temperature lower than that of the glass ceramic layer 14 by more than 100° C. The glass ceramic layer 27 has a thickness ranging from 50 μm to 500 μm. The glass ceramic layer 27 prevents bismuth, an additive contained in the varistor layer 12, from evaporating during the baking process, thereby providing the varistor layer 12 with varistor characteristics and reliability. The hole 124 has a depth greater than that of the hole 24 shown in FIG. 17, accordingly allowing the wall surface 124A to have an area larger than that of the wall surface 24A. The wall surface 124A of the hole 124 allows light emitted from the light emitting diode mounted in the hole 24 to converge in a single direction, thereby providing bright light.

The features described above may be used separately, but may be combined.

Exemplary Embodiment 6

Figure 19:
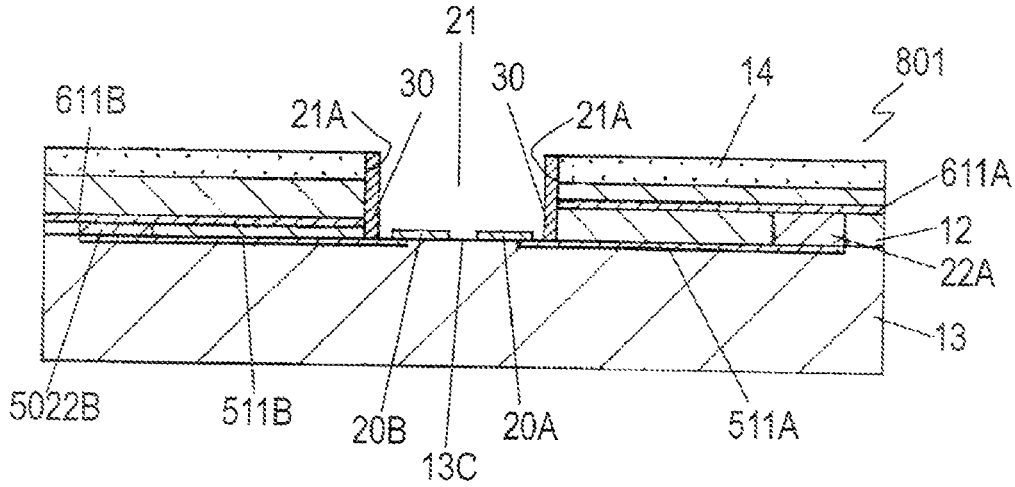
FIG. 19 is a cross-sectional view of a varistor according to Exemplary Embodiment 6 of the invention.

FIG. 19 is a cross-sectional view of a varistor 801 according to Exemplary Embodiment 6 of the present invention. The varistor 801 further includes an insulating layer 30 of insulating material on the wall surface 21A of the hole 21 provided in the varistor layer 12 and the glass ceramic layer 14 of the varistor 601 shown in FIGS. 12A to 12C and 13. The insulating layer 30 prevents the inner electrodes 611A and 611B from exposing to the wall surface 21A of the hole 21.

The internal electrodes 611A and 611B do not expose. This arrangement protects the electrodes 611A and 611B from being affected, for example, by plating liquid when the terminals of the varistor 801 are formed by plating. This allows the plating liquid to be selected from more kinds of chemicals, hence increasing the selection of the method of forming the terminals.

Exemplary Embodiment 7

Figure 20:
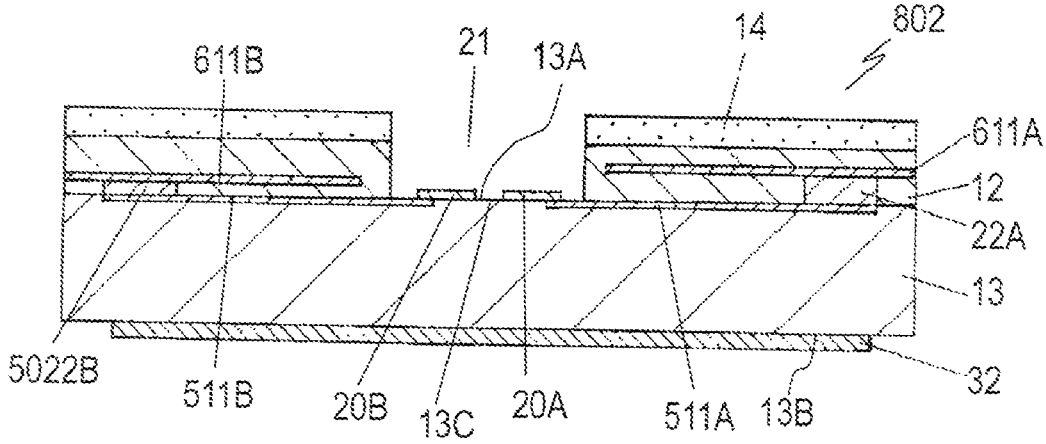
FIG. 20 is a cross-sectional view of a varistor according to Exemplary Embodiment 7 of the invention.

FIG. 20 is a cross-sectional view of a varistor 802 according to Exemplary Embodiment 7 of the present invention. The varistor 802 further includes a thermally conductive layer 32 provided on the surface 13B of the ceramic substrate 13 opposite to the surface 13A of the varistor 601 shown in FIGS. 12A to 12C and 13. The thermally conductive layer 32 is made of material, such as metal, having a high thermal-conductivity for facilitating the dissipation of heat from the ceramic substrate 13. In view of heat-dissipation, the thermally conductive layer 32 contains preferably more than 90% by weight of silver. For further improving the heat-dissipation, the thermally conductive layer 32 may be provided not only on a portion of the surface opposite to the terminal electrodes 20A and 20B, but also on an area more than the portion.

If the varistor 802 includes the external electrodes shown in FIG. 1 and the thermally conductive layer 32 is made of electrically conductive material, such as metal, the area where the thermally conductive layer 32 is provided is determined to prevent the external electrodes and the thermally conductive layer 32 from short-circuit.

Figure 21A:
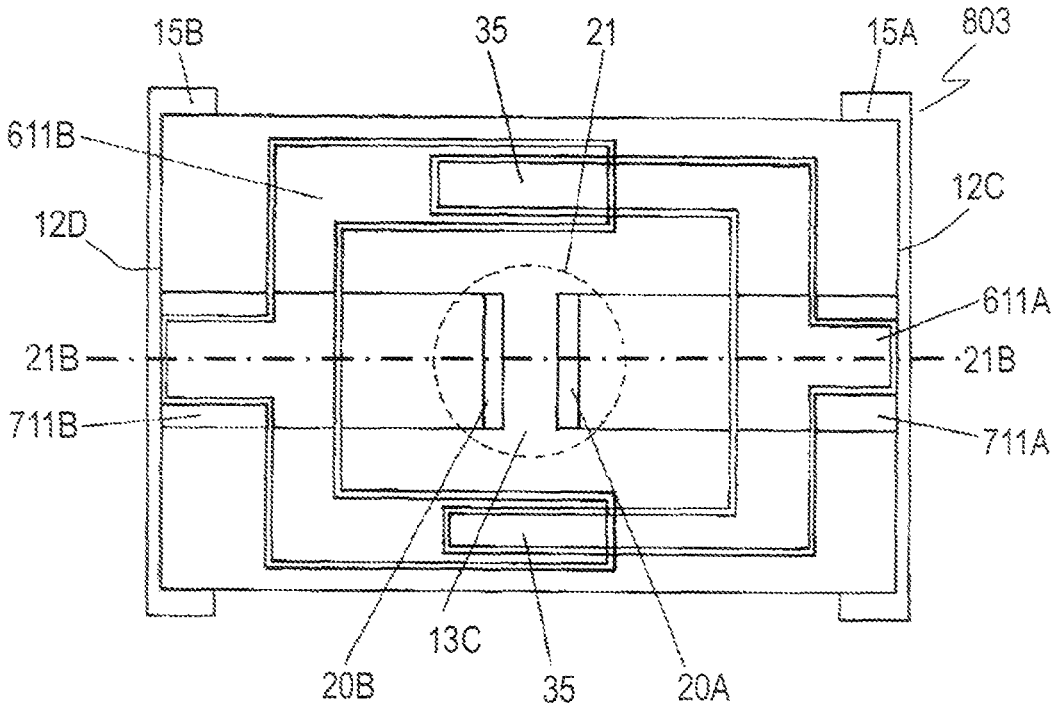
FIG. 21A is a top view of another varistor according to Embodiment 7.
Figure 21B:
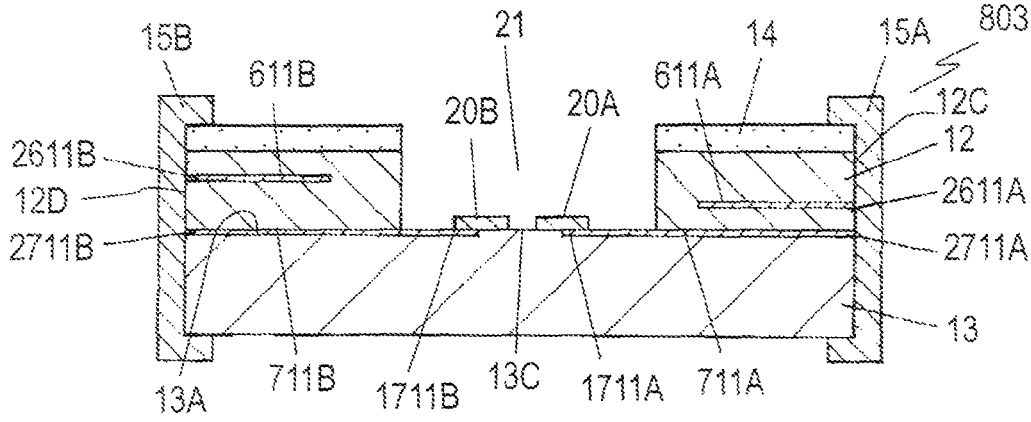
FIG. 21B is a cross-sectional view of the varistor at 21B-21B shown in FIG. 21A.

FIG. 21A is a top perspective view of another varistor 803 according to Embodiment 7. FIG. 21B is a cross-sectional view of the varistor 803 at line 21B-21B shown in FIG. 21A. The varistor 803 includes internal electrodes 711A and 711B instead of the internal electrodes 511A and 511B of the varistor 602 shown in FIG. 15, and further includes the external electrodes 15A and 15B.

The varistor 803 has a hole 21 provided in the varistor layer 12 and the glass ceramic layer 14, such that the portion 13C of the surface 13A of the ceramic substrate 13 exposes from the hole. The terminal electrodes 20A and 20B are provided on the portion 13C of the surface 13A for mounting an electronic component. The internal electrodes 711A and 711B are provided at the interface between the varistor layer 12 and the ceramic substrate 13, i.e., are provided on the surface 13A of the ceramic substrate 13, and has ends 1711A and 1711B on the portion 13C, respectively. The terminal electrodes 20A and 20B are provided on and connected to the ends 1711A and 1711B of the internal electrodes 711A and 711B exposing to the hole 21. The internal electrodes 611A and 711A have ends 2611A and 2711A exposing outward from an end surface 12C of the varistor layer 12, respectively. The internal electrodes 611B and 711B have ends 2611B and 2711B exposing outward from an end surface 12D of the varistor layer 12, respectively. The external electrode 15A is provided on the end surface 12C of the varistor layer 12 and connected to the ends 2611A and 2711A of the internal electrodes 611A and 711A. The external electrode 15B is provided on the end surface 12D of the varistor layer 12 and connected to the ends 2611B and 2711B of the internal electrodes 611B and 711B.

As shown in FIG. 21A, the internal electrodes 611A and 611B face each other across portions 35 of the varistor 12, hence providing the portions 35 of the varistor 803 with characteristics as a varistor.

Figure 22A:
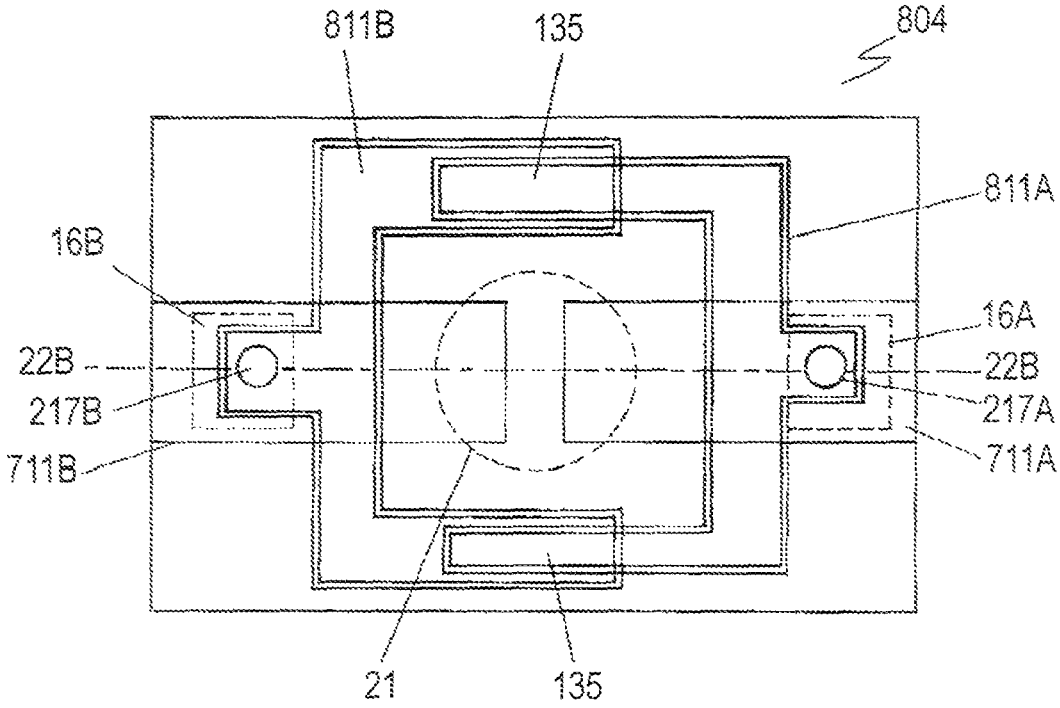
FIG. 22A is a top view of a further varistor according to Embodiment 7.
Figure 22B:
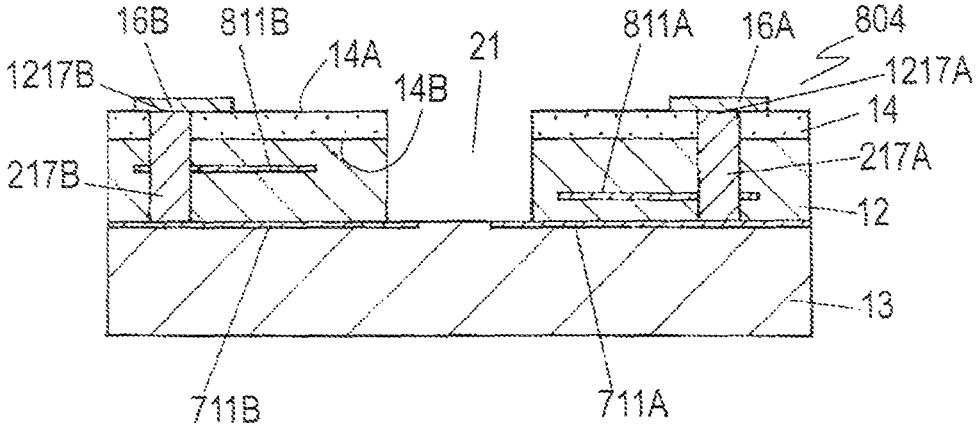
FIG. 22B is a cross-sectional view of the varistor at line 22B-22B shown in FIG. 22A.

FIG. 22A is a top perspective view of a further varistor 804 according to Embodiment 7. FIG. 22B is a cross-sectional view of the varistor 804 at line 22B-22B shown in FIG. 22A. The varistor 804 includes internal electrodes 811A and 811B instead of the internal electrodes 611A and 611B of the varistor 803 shown in FIGS. 21A and 21B, and further includes via-hole electrodes 217A and 217B and terminal electrodes 16A and 16B.

In the varistor 804, the internal electrode 811A or 811B does not expose from the varistor layer 12, different from the internal electrodes 611A and 611B shown in FIG. 21B. The via-hole electrode 217A is connected to the internal electrodes 711A and 811A and has a portion 1217A exposing from the surface 14A of the glass ceramic layer 14. The terminal electrode 16A is provided on the surface 14A of the glass ceramic layer 14 and connected to the portion 1217A of the via-hole electrode 217A. Similarly, the via-hole electrode 217B is connected to the internal electrodes 711B and 811B, and has a portion 1217B exposing from the surface 14A of the glass ceramic layer 14. The terminal electrode 16B is provided on the surface 14A of the glass ceramic layer 14 and connected to the portion 1217B of the via-hole electrode 217B.

The varistor 804 may include the external electrodes 15A and 15b shown in FIGS. 21A and 21B.

As shown in FIG. 22A, the internal electrodes 811A and 811B face each other across portions 135 of the varistor 12. The portions 135 provide the varistor 804 with characteristics as a varistor.

Figure 23:
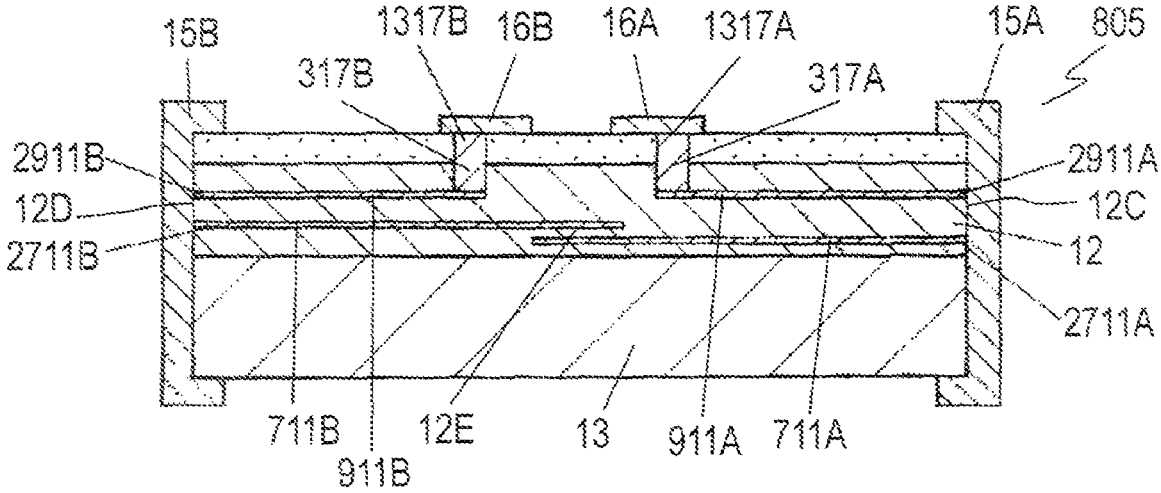
FIG. 23 is a cross-sectional view of a still further varistor according to Embodiment 7.
Figure 24:
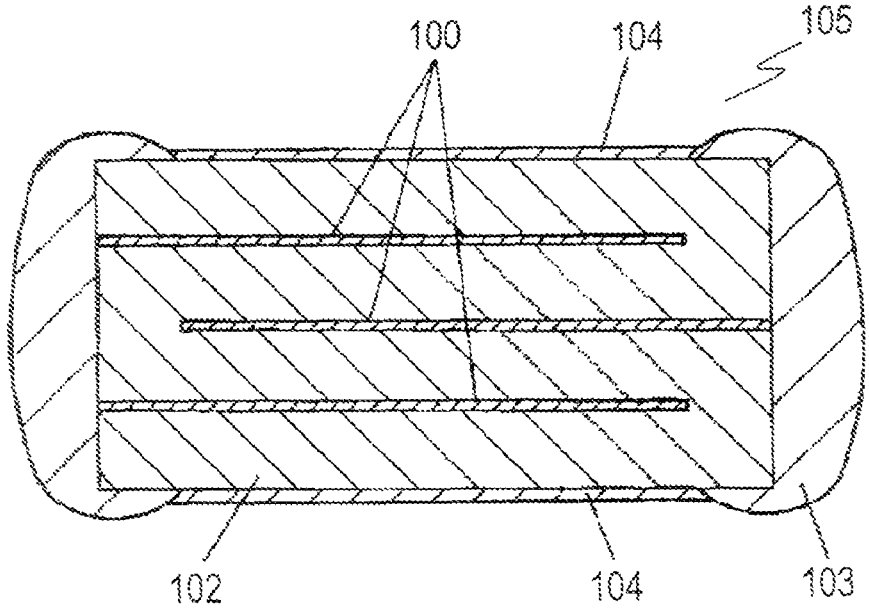
FIG. 24 is a cross-sectional view of a conventional varistor.

FIG. 23 is a cross-sectional view of a still further varistor 805 according to Embodiment 7. In this varistor, a varistor element is implemented by the internal electrodes 711A and 711B. The varistor 805 includes internal electrodes 911A and 911B instead of the internal electrodes 611A and 611B of the varistor 803 shown in FIGS. 21A and 21B, and further includes via-hole electrodes 317A and 317B and the terminal electrodes 16A and 16B.

The internal electrodes 711A and 711B are provided on the surface 13A of the ceramic substrate 13, and have ends 2711A and 2711B exposing from both the end surfaces 12C and 12D of the varistor layer 12, respectively. The external electrodes 15A and 15B are provided on the end surfaces 12C and 12D and connected to the ends 2711A and 2711B of the internal electrodes 711A and 711B, respectively. The internal electrodes 711A and 711B face each other across a portion 12E of the varistor layer 12, and the portion 12E provides characteristics as a varistor.

The internal electrodes 911A and 911B have ends 2911A and 2911B exposing from the end surfaces 12C and 12D of the varistor layer 12 and connected to the external electrodes 15A and 15B, respectively. The via-hole electrodes 317A and 317B are connected to the internal electrodes 911A and 911B, and have portions 1317A and 1317B exposing from the surface 14A of the glass ceramic layer 14. The terminal electrodes 16A and 16B are provided on the surface 14A and connected to portions 1317A and 1317B of the via-hole electrodes 317A and 317B, respectively. That is, the internal electrode 711A is connected to the terminal electrode 16A via the external electrode 15A, the internal electrode 911A, and the via-hole electrode 317A. The internal electrode 711B is connected to the terminal electrode 16B via the external electrode 15B, the internal electrode 911B, and the via-hole electrode 317B.

INDUSTRIAL APPLICABILITY

A varistor according to the present invention has a small, thin size, and has sufficient varistor characteristics against surge voltages. Accordingly, the varistor is useful for a small electronic component module having resistance to static electricity and surge voltage.

The invention claimed is:

1. A varistor comprising:

a ceramic substrate having an insulating property;

a varistor layer having a first surface and a second surface opposite to the first surface, the first surface being provided on the ceramic substrate, the varistor layer mainly containing zinc oxide;

a first glass ceramic layer provided on the second surface of the varistor layer, the first glass ceramic layer containing glass material, the first glass ceramic layer having a thickness ranging from 5 μm to 50 μm;

a first internal electrode provided in the varistor layer; and a second internal electrode provided in the varistor layer, the second internal electrode facing the first internal electrode in the varistor layer.

2. The varistor according to claim 1, wherein the first internal electrode and the second internal electrode are apart from the first surface of the varistor layer by a distance not smaller than 10 μm.

3. The varistor according to claim 1, wherein the first internal electrode and the second internal electrode are apart from the second surface of the varistor layer by a distance not smaller than 10 μm.

4. The varistor according to claim 1, wherein the ceramic substrate mainly contains at least one of aluminum oxide, zirconium oxide, silicon oxide and magnesium oxide.

5. The varistor according to claim 1, further comprising:

a first external electrode provided exposing to outside of said varistor and electrically connected to the first internal electrode; and a second external electrode provided exposing to outside of said varistor and electrically connected to the second internal electrode.

6. The varistor according to claim 5, wherein the varistor layer has an end surface, the first internal electrode and the second internal electrode have a first end and a second end which expose from the end surface of the varistor layer, respectively, and the first external electrode and the second external electrode are provided on the end surface of the varistor layer and connected to the first end and the second end, respectively.

7. The varistor according to claim 5, wherein the end surface of the varistor layer comprises a first end surface and a second end surface, the first internal electrode has a first end exposing from the first end surface of the varistor layer, the second internal electrode has a second end exposing from the second end surface of the varistor layer, and the first external electrode and the second terminal electrode are provided on the first end surface and the second end surface of the varistor layer, respectively.

8. A varistor comprising:

a ceramic substrate having an insulating property;

a varistor layer having a first surface and a second surface opposite to the first surface, the first surface being provided on the ceramic substrate, the varistor layer mainly containing zinc oxide;

a first glass ceramic layer provided on the second surface of the varistor layer, the first glass ceramic layer containing glass material, the first glass ceramic layer having a thickness ranging from 5 μm to 50 μm;

a first internal electrode provided in the varistor layer;

a second internal electrode provided in the varistor layer, the second internal electrode facing the first internal electrode in the varistor layer;

a first external electrode provided exposing to outside of said varistor and electrically connected to the first internal electrode; and a second external electrode provided exposing to outside of said varistor and electrically connected to the second internal electrode, wherein the first glass ceramic layer has a first surface and a second surface opposite to the first surface of the first glass layer, the first surface of the first glass layer being provided on the second surface of the varistor layer, and the first external electrode and the second external electrode expose from the second surface of the first glass ceramic layer.

9. The varistor according to claim 8, wherein the first external electrode and the second external electrode contain metallic powder and 0.5 to 5.0% by weight of molybdenum trioxide for the metallic powder.

10. The varistor according to claim 8, further comprising:

a first via-hole electrode embedded in the first glass ceramic layer and the varistor layer, the first via-hole electrode being connected to the first internal electrode and the first external electrode; and a second via-hole electrode embedded in the first glass ceramic layer and the varistor layer, the second via-hole electrode being connected to the second internal electrode and the second external electrode.

11. The varistor according to claim 10, wherein the first via-hole electrode and the second via-hole electrode contain metallic powder and 0.5% to 5.0% by weight of molybdenum trioxide for the metallic powder.

12. The varistor according to claim 8, wherein the first external electrode is provided on the second surface of the first glass ceramic layer.

13. The varistor according to claim 8, wherein the first external electrode has a surface thereof, the surface of the first external electrode being covered partially with the first glass ceramic layer and exposing from the second surface of the first glass ceramic layer.

14. The varistor according to claim 13, wherein the surface of the first external electrode has a periphery thereof covered with a portion of the first glass ceramic layer, and the portion of the first glass ceramic layer has a thickness ranging from 3 μm to 10 μm and a width ranging from 20 μm to 100 μm.

15. A varistor comprising:

a ceramic substrate having an insulating property;

a varistor layer having a first surface and a second surface opposite to the first surface, the first surface being provided on the ceramic substrate, the varistor layer mainly containing zinc oxide;

a first glass ceramic layer provided on the second surface of the varistor layer, the first glass ceramic layer containing glass material, the first glass ceramic layer having a thickness ranging from 5 μm to 50 μm;

a first internal electrode provided in the varistor layer;

a second internal electrode provided in the varistor layer, the second internal electrode facing the first internal electrode in the varistor layer;

a first external electrode provided exposing to outside of said varistor and electrically connected to the first internal electrode; and a second external electrode provided exposing to outside of said varistor and electrically connected to the second internal electrode, wherein the ceramic substrate has a surface provided on the first surface of the varistor layer, the first glass ceramic layer and the varistor layer have a hole provided therein, the hole having an opening at the first glass ceramic layer and allowing the surface of the ceramic substrate at a bottom of the hole, and the first external electrode and the second external electrode are provided in the hole.

16. The varistor according to claim 15, wherein the first external electrode and the second external electrode are electrically connected in parallel with the first internal electrode and the second internal electrode.

17. The varistor according to claim 15, wherein the opening of the hole has a substantially circular shape.

18. The varistor according to claim 15, wherein the hole flares from the varistor layer towards the first glass ceramic layer.

19. The varistor according to claim 18, further comprising a light-reflecting layer provided on a wall surface of the hole.

20. The varistor according to claim 15, wherein the first glass ceramic layer has a first surface and a second surface of the first glass layer, the first surface being provided on the second surface of the varistor layer, said varistor further comprising a second glass ceramic layer provided on the second surface of the first glass ceramic layer, the second glass layer being made of glass material having a softening temperature lower than a softening temperature of the glass material of the first glass ceramic layer by not less than 100° C., and the opening of the hole opens at the second glass ceramic layer.

21. The varistor according to claim 20, wherein the second glass ceramic has a thickness ranging from 50 μm to 500 μm.

22. The varistor according to claim 15, wherein the hole has a wall surface, said varistor further comprising an insulating layer provided on the wall surface at the hole of the layers.

23. The varistor according to claim 1, wherein the ceramic substrate has a first surface and a second surface opposite to the first surface of the ceramic substrate, and the second surface of the ceramic substrate is provided on the first surface of the varistor layer, said varistor further comprises a thermally conductive layer provided on the first surface of the ceramic substrate.

24. The varistor according to claim 23, wherein the thermally conductive layer contains not smaller than 90% by weight of silver.

25. An electronic component module comprising:

the varistor defined in any of claims 8-22; and an electronic component having a first terminal and a second terminal connected to the first external electrode and the second external electrode of the varistor, respectively.

26. The electronic component module according to claim 25, wherein the electronic component comprises a light emitting diode.

27. An electronic component module comprising:

the varistor defined in any of claims 1, 2-5, 23, and 24; and an electronic component having a first terminal and a second terminal connected to the first external electrode and the second external electrode of the varistor, respectively.

28. The varistor according to claim 15, wherein the ceramic substrate has a first surface and a second surface opposite to the first surface of the ceramic substrate, and the second surface of the ceramic substrate is provided on the first surface of the varistor layer, said varistor further comprises a thermally conductive layer provided on the first surface of the ceramic substrate.

29. The varistor according to claim 28, wherein the thermally conductive layer contains not smaller than 90% by weight of silver.

* * * * *

UNITED STATES PATENT AND TRADEMARK OFFICE

CERTIFICATE OF CORRECTION

PATENT NO. : 7,940,155 B2
APPLICATION NO. : 11/817710
DATED : May 10, 2011
INVENTOR(S) : Hidenori Katsumura et al.

It is certified that error appears in the above-identified patent and that said Letters Patent is hereby corrected as shown below:

On the title page, item [75], please delete the third inventor's last name "Kobatashi" and instead insert --Kobayashi--.

Signed and Sealed this
Sixteenth Day of August, 2011

David J. Kappos

David J. Kappos
*Director of the United States Patent and Trademark Office*